US009777513B2

(12) United States Patent
Muller et al.

(10) Patent No.: US 9,777,513 B2
(45) Date of Patent: Oct. 3, 2017

(54) PULL-OUT DEVICE FOR AT LEAST TWO PULL-OUT FURNITURE PARTS

(71) Applicant: FULTERER Gesellschaft mbH, Lustenau (AT)

(72) Inventors: Wolfgang Muller, Lustenau (AT); Edwin Grubel, Widnau (CH)

(73) Assignee: FULTERER Gesellschaft mbH, Lustenau (AT)

( * ) Notice: Subject to any disclaimer, the term of this patent is extended or adjusted under 35 U.S.C. 154(b) by 617 days.

(21) Appl. No.: 14/373,438

(22) PCT Filed: Jan. 17, 2013

(86) PCT No.: PCT/AT2013/000004
§ 371 (c)(1),
(2) Date: Jul. 21, 2014

(87) PCT Pub. No.: WO2013/110102
PCT Pub. Date: Aug. 1, 2013

(65) Prior Publication Data

US 2015/0001860 A1 Jan. 1, 2015

(30) Foreign Application Priority Data

Jan. 25, 2012 (AT) ..... A 86/2012

(51) Int. Cl.
*E05B 65/46* (2017.01)
*E05B 65/462* (2017.01)
(Continued)

(52) U.S. Cl.
CPC ..... *E05B 65/462* (2013.01); *A47B 88/40* (2017.01); *A47B 88/467* (2017.01);
(Continued)

(58) Field of Classification Search
CPC .... E05B 65/463; E05B 65/464; E05B 65/465; E05B 65/462; E05B 17/0025;
(Continued)

(56) References Cited

U.S. PATENT DOCUMENTS 2,653,043 A 9/1953 Carlson
4,426,752 A 1/1984 Nakayama
(Continued)

FOREIGN PATENT DOCUMENTS

AT 393948 10/1992
AT 401334 8/1996
(Continued)

*Primary Examiner* — Hanh V Tran
(74) *Attorney, Agent, or Firm* — Volpe and Koenig, P.C.

(57) ABSTRACT

A device for blocking the pull-out movement of pull-out furniture parts including, for each of the pull-out furniture parts, a driver, a blocking unit which has a shiftable actuating, and a retraction spring and blocking rods which cooperate with the actuating parts, a respective actuating part that is shifted due to movement of the driver when the pull-out furniture part is pulled out and that displaces a blocking rod in a longitudinal axis direction, the blocking rods being blocked from any further axial displacement by a stop. Each of the blocking units has a pivotable catch arm that swivelable about a stationary pivot axis lying parallel to the longitudinal axes of the blocking rods and is loaded by the refraction spring, the catch arm being pivoted by the driver from an initial position to a final position when the pull-out furniture part is pulled out, thereby shifting the actuating part.

14 Claims, 12 Drawing Sheets

(51) Int. Cl.

| | |
|---|---|
| ***E05B 65/464*** | (2017.01) |
| ***E05B 17/00*** | (2006.01) |
| ***A47B 88/40*** | (2017.01) |
| ***A47B 88/467*** | (2017.01) |
| *E05B 15/04* | (2006.01) |

(52) U.S. Cl.
CPC ..... *E05B 17/0025* (2013.01); *E05B 17/0041* (2013.01); *E05B 65/464* (2013.01); *A47B 2210/0094* (2013.01); *E05B 2015/0493* (2013.01); *Y10T 292/1016* (2015.04)

(58) Field of Classification Search
CPC ..... E05B 17/0041; E05B 2015/0493; Y10T 292/1016; A47B 2210/0094; A47B 88/40; A47B 88/467
See application file for complete search history.

(56) References Cited

U.S. PATENT DOCUMENTS

| | | | | |
|---|---|---|---|---|
| 4,603,239 | A | 7/1986 | Ishii | |
| 4,697,673 | A | 10/1987 | Omata | |
| 4,732,434 | A | 3/1988 | Hartrum | |
| 4,772,078 | A * | 9/1988 | Bowyer | E05B 65/464 312/220 |
| 4,830,151 | A | 5/1989 | Numata | |
| 5,040,858 | A * | 8/1991 | Kruse | E05B 65/463 312/221 |
| 5,050,942 | A * | 9/1991 | Frederick | E05B 65/464 312/221 |
| 5,143,432 | A | 9/1992 | Ohshima et al. | |
| 5,240,318 | A | 8/1993 | Schroder et al. | |
| 5,277,282 | A | 1/1994 | Umemura | |
| 5,303,994 | A | 4/1994 | Elsholz | |
| 5,335,563 | A | 8/1994 | Yamamoto et al. | |
| 5,335,986 | A * | 8/1994 | Hartrum | E05B 65/463 312/217 |
| 5,460,252 | A | 10/1995 | Kosugi et al. | |
| 5,887,930 | A | 3/1999 | Klein | |
| 6,095,626 | A | 8/2000 | Lautenschlager | |
| 6,312,186 | B1 | 11/2001 | Rock et al. | |
| 6,866,588 | B2 | 3/2005 | Doornboos | |
| 7,032,985 | B1 | 4/2006 | Ichioka et al. | |
| 7,101,001 | B1 * | 9/2006 | Chiu | E05B 65/464 312/217 |
| 7,320,507 | B2 * | 1/2008 | White | E05B 65/464 312/217 |
| 7,815,267 | B1 | 10/2010 | Frousiakis | |
| 2002/0078529 | A1 | 6/2002 | Schwarz | |
| 2002/0101014 | A1 | 8/2002 | Kurihara et al. | |
| 2002/0157495 | A1 | 10/2002 | Goto et al. | |
| 2002/0170794 | A1 | 11/2002 | Dubach | |
| 2002/0185943 | A1 * | 12/2002 | Gentili | E05B 65/464 312/221 |
| 2003/0076016 | A1 * | 4/2003 | Westwinkel | E05B 65/464 312/221 |
| 2004/0100165 | A1 * | 5/2004 | Hoffman | E05B 65/466 312/219 |
| 2004/0130246 | A1 * | 7/2004 | Dube | E05B 65/464 312/221 |
| 2005/0040659 | A1 * | 2/2005 | Baker | E05B 65/463 292/338 |
| 2005/0115784 | A1 | 6/2005 | Muller et al. | |
| 2006/0061245 | A1 | 3/2006 | Huber et al. | |
| 2006/0066187 | A1 * | 3/2006 | Chang | E05B 65/464 312/219 |
| 2006/0113154 | A1 | 6/2006 | Hayashi et al. | |
| 2006/0118371 | A1 | 6/2006 | Zimmer et al. | |
| 2006/0125357 | A1 * | 6/2006 | Ludwig | E05B 65/464 312/221 |
| 2006/0267461 | A1 * | 11/2006 | Hoffman | E05B 65/466 312/219 |
| 2007/0018542 | A1 * | 1/2007 | Liao | E05B 65/463 312/221 |
| 2007/0145867 | A1 | 6/2007 | Gasser | |
| 2007/0182292 | A1 * | 8/2007 | Huang | E05B 65/464 312/221 |
| 2008/0061663 | A1 * | 3/2008 | Wu | E05B 65/463 312/333 |
| 2008/0290774 | A1 | 11/2008 | Gasser et al. | |
| 2009/0079312 | A1 | 3/2009 | Laible | |
| 2010/0027923 | A1 | 2/2010 | Bonat | |
| 2010/0194256 | A1 | 8/2010 | Grabherr | |
| 2010/0264794 | A1 | 10/2010 | Hu et al. | |
| 2011/0001410 | A1 | 1/2011 | Chen et al. | |
| 2011/0001412 | A1 | 1/2011 | Zimmerman | |
| 2011/0043087 | A1 | 2/2011 | Shih et al. | |
| 2011/0067964 | A1 | 3/2011 | Krammer et al. | |
| 2011/0101839 | A1 | 5/2011 | Boks | |
| 2011/0175508 | A1 | 7/2011 | Rechberg | |
| 2011/0176755 | A1 | 7/2011 | Chen et al. | |
| 2012/0068590 | A1 * | 3/2012 | Chen | E05B 65/464 312/333 |
| 2012/0144622 | A1 | 6/2012 | Juan et al. | |
| 2013/0133157 | A1 | 5/2013 | Kimura | |
| 2013/0153347 | A1 | 6/2013 | Oda et al. | |
| 2015/0091427 | A1 | 4/2015 | Haemmerle et al. | |

FOREIGN PATENT DOCUMENTS

| | | | |
|---|---|---|---|
| AT | 503877 | | 1/2008 |
| AT | 503877 | B1 | 9/2009 |
| CA | 2013633 | | 10/1990 |
| CA | 2048153 | | 2/1992 |
| CA | 2220615 | A2 | 5/1998 |
| CN | 1367326 | | 9/2002 |
| DE | 601293 | | 8/1934 |
| DE | 601293 | C | 8/1934 |
| DE | 654017 | C | 12/1937 |
| DE | 2911772 | A1 | 10/1979 |
| DE | 3431386 | | 3/1986 |
| DE | 3431386 | A1 | 3/1986 |
| DE | 9012423 | | 12/1990 |
| DE | 9311534 | U1 | 12/1993 |
| DE | 9311534 | | 1/1994 |
| DE | 4325920 | | 2/1995 |
| DE | 4325920 | C2 | 2/1995 |
| DE | 4427026 | | 8/1995 |
| DE | 29620152 | | 5/1997 |
| DE | 29622864 | | 9/1997 |
| DE | 19615433 | A1 | 1/1998 |
| DE | 19634581 | A1 | 1/1998 |
| DE | 19717937 | | 5/1998 |
| DE | 19938626 | | 7/2001 |
| DE | 19938626 | A1 | 7/2001 |
| DE | 20202520 | | 6/2002 |
| DE | 10214596 | | 1/2003 |
| DE | 10214596 | A1 | 1/2003 |
| DE | 20116197 | | 2/2003 |
| DE | 20116197 | U1 | 2/2003 |
| DE | 10213726 | | 10/2003 |
| DE | 10213726 | A1 | 10/2003 |
| DE | 10210917 | | 11/2003 |
| DE | 10313659 | | 9/2004 |
| DE | 20308218 | U1 | 9/2004 |
| DE | 202005020820 | U1 | 8/2006 |
| DE | 202005020820 | | 9/2006 |
| DE | 102006022563 | A1 | 11/2007 |
| DE | 102006051688 | A1 | 5/2008 |
| DE | 20 2009 002 035 | U1 | 8/2010 |
| DE | 102009012921 | A1 | 9/2010 |
| DE | 102009012922 | A1 | 9/2010 |
| DE | 102011051907 | A1 | 1/2013 |
| EP | 0593810 | | 4/1994 |
| EP | 0951848 | A1 | 10/1999 |
| EP | 1260159 | | 11/2002 |
| EP | 1336709 | A1 | 12/2002 |
| EP | 1336709 | | 8/2003 |
| EP | 1384420 | | 1/2004 |
| EP | 1384420 | A1 | 1/2004 |
| EP | 1500763 | | 1/2005 |
| EP | 1500763 | A2 | 1/2005 |
| EP | 1532892 | | 5/2005 |

(56) References Cited

FOREIGN PATENT DOCUMENTS

| | | | |
|---|---|---|---|
| EP | 1532892 | A1 | 5/2005 |
| EP | 1561398 | A1 | 8/2005 |
| EP | 2620079 | A1 | 7/2013 |
| GB | 1117071 | | 6/1968 |
| GB | 1117071 | A | 6/1968 |
| GB | 2302906 | | 2/1997 |
| GB | 2376043 | | 12/2002 |
| GB | 2376043 | A | 12/2002 |
| JP | 59222631 | | 12/1984 |
| JP | 59222631 | A2 | 12/1984 |
| JP | 0126631 | | 10/1989 |
| JP | 01266331 | A | 10/1989 |
| JP | 4321825 | | 11/1992 |
| WO | 2007090210 | | 8/2007 |
| WO | 2008107499 | | 9/2008 |
| WO | 2008107499 | A1 | 9/2008 |
| WO | 2011069175 | A1 | 6/2011 |
| WO | 2013110099 | A1 | 8/2013 |
| WO | 2013110100 | A1 | 8/2013 |
| WO | 2013110101 | A1 | 8/2013 |
| WO | 2013138826 | A1 | 9/2013 |

* cited by examiner

Fig. 21
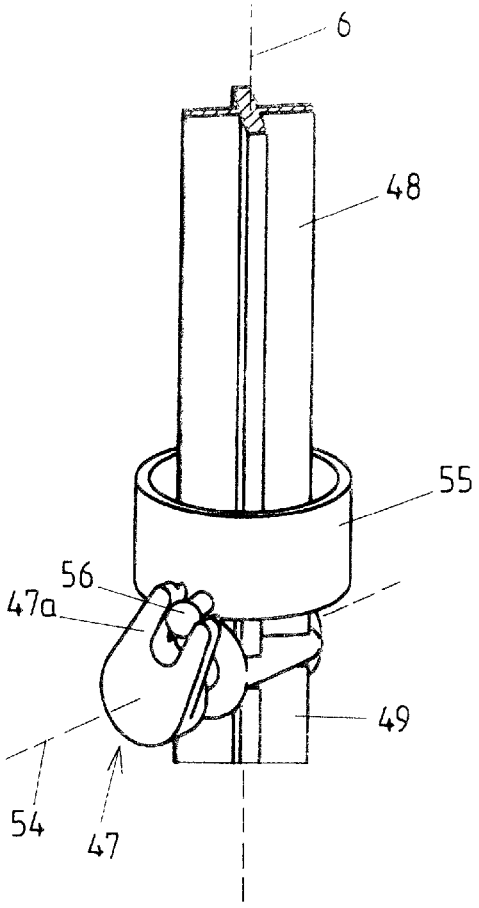
Fig. 22
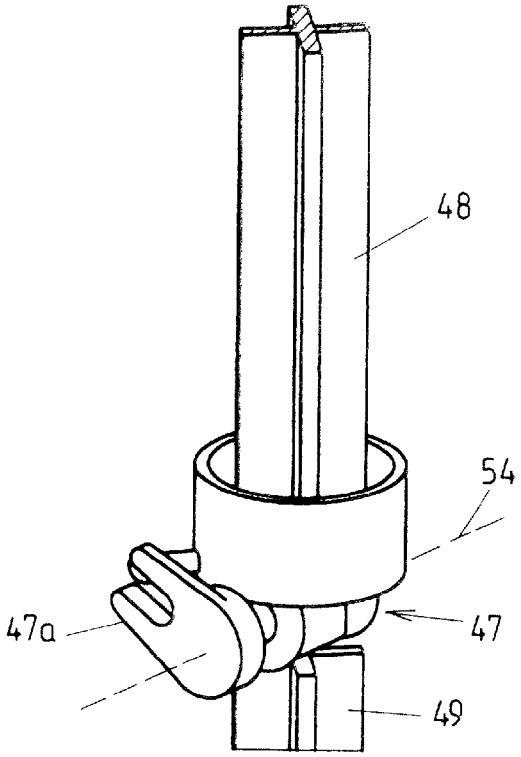
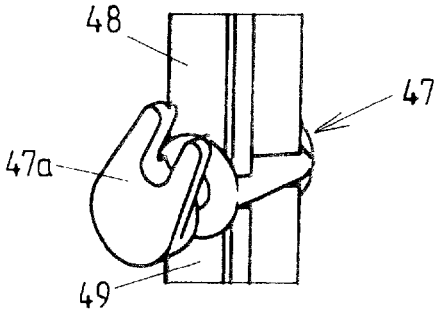
Fig. 23
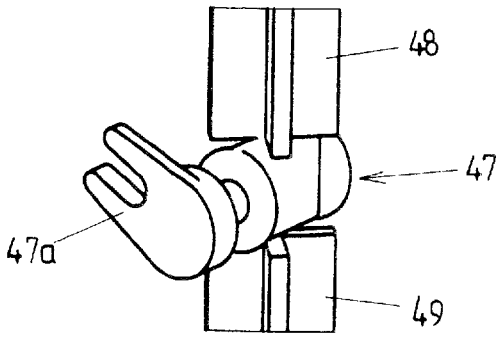
Fig. 24

PULL-OUT DEVICE FOR AT LEAST TWO PULL-OUT FURNITURE PARTS

BACKGROUND

The invention relates to a pull-out blocking device for at least two pull-out furniture parts which can be pulled out from a furniture body in a pull-out direction from a completely refracted position into a completely pulled-out position and can be retracted into the furniture body in an opposite direction to the pull-out direction, said pull-out blocking device including, for each of the pull-out furniture parts, a driver which is displaced in the pull-out direction when the pull-out furniture part is pulled out and in an opposite direction to the pull-out direction when the pull-out furniture part is refracted, for each of the pull-out furniture parts, a blocking unit which comprises an actuating part, which is adjusted as a result of the movement of the driver when one of the pull-out furniture parts is pulled out and retracted, as well as a retraction spring by means of which the respectively associated pull-out furniture part is retractable over a last portion of the path it covers when retracting into the furniture body, blocking rods which interact with the actuating parts and are mounted so as to be displaceable in the direction of their longitudinal axes, wherein a respective actuating part, which is adjusted as a result of the movement of the driver associated therewith when the associated pull-out furniture part is pulled out, displaces at least one of the blocking rods in the direction of its longitudinal axis and, as a result, the blocking rods are blocked against further axial displacement by means of a stop.

Pull-out blocking devices prevent two or more pull-out furniture parts, which are coupled together by means of the pull-out blocking device, e.g. drawers which are arranged one above another, from being pulled out simultaneously. The pull-out furniture parts can therefore only be pulled out alternately. Central blocking is also frequently realized by means of such pull-out blocking devices.

In a conventional design, such a pull-out blocking device comprises blocking rods which only have limited space for the displacement thereof. An actuating part, which interacts with at least one of the blocking rods, is provided for each pull-out furniture part. When one of the pull-out furniture parts is pulled out, at least one of the blocking rods is displaced by the corresponding actuating part. In this case, the space for the displacement of the blocking rods is used up and the blocking rods are blocked against further displacement by means of a stop. A further pull-out furniture part can consequently not be pulled out at the same time.

Various embodiments of pull-out blocking devices with blocking rods are known. For example, DE 29 620 152 U1, EP 1 336 709 A1 and WO 2008/107499 A1 show the blocking rods being actuated by actuating parts which, when the respective pull-out furniture part is pulled out, are pivoted by the driver about a pivot axis which lies at right angles to the longitudinal axes of the blocking rods. Apart from the actuating part which is provided for displacing the blocking rod that is furthest away from the stop, the actuating parts each lie between two of the blocking rods and are arranged so as to be displaceable with said blocking rods. Pull-out blocking devices which are realized in a similar manner proceed from DE 34 31 386 C2, DE 93 11 534 U1 and DE 43 25 920 C2, the actuating parts in this case being pivotable about axes which lie parallel to the longitudinal axes of the blocking rods.

GB 2376043 A shows a pull-out blocking device where the actuating parts which interact with the blocking rods are pivotable about pivot axes which lie parallel to the longitudinal axes of the actuating rods. The actuating parts are provided with radially protruding continuations which form catch arms which are actuated by the drivers which are mounted on the pull-out furniture parts. When one of the pull-out furniture parts is pulled out, the catch arm is pivoted by the driver from an initial position into an end position, a portion of the catch arm moving into a recess and locking in said recess which is provided in a respective housing. The housings mount the blocking rods so as to be displaceable. The rotatable bearing arrangement of the actuating parts and with them the catch arms is effected as a result of axial projections of the actuating parts which are accommodated by axial openings in end portions of the blocking rods.

A pull-out blocking device of the type named in the introduction which is combined with a retracting device proceeds from EP 1 500 763 A2. Retracting devices (also called self-closing or pull-in mechanisms) serve for the purpose of automatically retracting a pull-out furniture part over a final portion of its retraction path and thus ensuring the completely retracted state of the pull-out furniture part. In the case of the device known from EP 1 500 763 A2, the actuating parts which interact with the blocking rods are formed by slides which are mounted so as to be displaceable in a straight line. Said slides are in each case acted upon by a retraction spring which is tensioned when the slide is displaced from the initial position into the end position. A tilting part is mounted on the slide so as to be displaceable about an axis which lies parallel to the blocking rods and is entrained with the slide. When one of the pull-out furniture parts is pulled out, the driver thereof engages in the tilting part and entrains the tilting part and consequently the slide until the slide reaches its end position, the tilting part tilting, as a result of which the driver is able to move out and the slide is locked in the end position. When the pull-out furniture part is retracted, the approaching driver pivots the tilting part back, as a result of which the driver is coupled to the tilting part and the locking of the slide in the end position is lifted such that the slide is pulled by the retraction spring in the direction of its initial position. The movement of the slide, in this connection, is damped by a damper which is formed by a piston-cylinder unit.

Retraction devices with and without damping devices are known from a plurality of further publications. For example, a pull-in mechanism where there is a tilt slider which is displaceable against the force of a spring proceeds from AT 401334 B. The tilt slider is arranged on a slide, which is displaceable in a straight line against the force of the spring in the pull-out direction of the drawer, so as to be tiltable about a tilt axis. In the case of the retraction device known from AT 393948 B, there is also a tilt slider which is displaceable against the force of a spring along a guide path. The guide path has a straight portion and a curved portion which brings about the pivoting of the tilt slider about an imaginary tilt axis into its tilted end position. A further damped retraction device where the tilt slider interacts with a push-in damper is known, for example, from EP 1 532 892 A1. The spring-loaded tilt slider interacts, in this case, with a linear damper in the form of a piston-cylinder unit which operates, in particular, in a pneumatic manner. Self-closing mechanisms which are damped by means of rotary dampers are also known.

A retraction device with a bent arm, which is mounted so as to be rotatable about a stationary horizontal axis and is acted upon by a retraction spring, which is incorporated into a piston-cylinder unit which forms a damper, proceeds from EP 1 384 420 B1. A driver, which interacts with the catch arm and comprises a sliding path, is arranged on the rear side of the full-out furniture part. When the pull-out furniture part is pulled out, the arm, proceeding from an initial position, is pivoted about the horizontal axis into an end position in which the driver is uncoupled from the arm. When the arm is pivoted from the initial position into the end position, a dead point of the retraction spring is traveled over.

A locking device, where a spring-loaded catch part which is mounted so as to be pivotable about an axis is pivoted by a driver, which is mounted on the pull-out furniture part, between an initial position and the end position, proceeds from GB 1,117,071. The spring, in this connection, is moved over a dead point.

Further dampers which are realized in the form of piston-cylinder units for damping the retraction movement of movably mounted furniture parts proceed, for example, from DE 20 2005 020 820 U1 and DE 10 213 726 A1. In addition, rotary dampers are known where a highly viscous medium is arranged in a gap between a fixed damper part and a rotatably mounted damper part. The braking force is produced by said damping medium which is stressed with shear. Dampers of this type proceed, for example, from DE 10 210 917 C1, U.S. Pat. No. 5,277,282 A, JP 59-222631 A and U.S. Pat. No. 5,143,432 A.

In addition, friction dampers which operate in a purely mechanical manner are known. Thus, wraparound parts which surround an internal friction part and with said part realize a friction pairing proceed, for example, from DE 19 938 626 A1, DE 201 16 197 U1 and JP 01-266331 A. The disadvantage of friction dampers is that the braking force they exert is basically not dependent on speed.

DE 10 313 659 B3, DE 10 214 596 A1, DE 19 717 937 A1, AT 503 877 B1 and EP 1 260 159 A2 make known piston-cylinder units where an air pressure difference that is realized between the two piston sides acts on an elastically deformable piston part such that the exerted friction force depends on the air pressure difference and consequently on the speed of the component to be damped. A vehicle shock absorber where a flexibly realized wraparound part which abuts in a frictional manner against an inner friction part that is formed by a friction drum proceeds from DE 601 293 C. As a result of coupling one end of the wraparound part with a hydraulically operating damper, the friction force acting between the wraparound part and the friction drum is able to be influenced.

SUMMARY

It is the object of the invention to provide an improved pull-out blocking device of the type mentioned in the introduction with an incorporated retraction device. This is achieved with a pull-out blocking device with one or more features of the invention.

In the case of the pull-out blocking device of the invention, each of the blocking units comprises a catch arm, which is mounted so as to be pivotable about a stationary pivot axis that lies parallel to the longitudinal axes of the blocking rods and is acted upon by the retraction spring of said blocking unit. The catch arm is pivoted from an initial position into an end position by the driver associated therewith (that is the one that interacts with said catch arm) when the associated pull-out furniture part (that is the one by way of which said driver is entrained when pulled out and retracted) is pulled out when, proceeding from its completely retracted position, the associated pull-out furniture part is pulled out into its completely pulled-out position or the driver is moved over a corresponding path.

When the driver, when the pull-out furniture part is pulled out, has pivoted the catch arm from its initial position into its end position, the driver uncouples from the catch arm as the pull-out furniture part is pulled out further.

When the respective catch arm is pivoted from its initial position into the end position, the catch arm adjusts the actuating part directly or indirectly by means of at least one transmission member. The actuating part is preferably a component which is separate from the catch arm and is coupled to said catch arm directly or by means of the at least one transmission member. However, it is also conceivable and possible for the actuating part to be realized integrally with the catch arm.

A compact and sturdy design is made possible as a result of the invention. In this connection, a design that is also suitable for pull-outs for heavy loads is made possible. Pull-out furniture parts of which one, several or all are loadable with in excess of 150 kg are provided in the case of heavy load pull-outs.

In particular, the blocking rods include blocking rods which extend between the actuating parts and one blocking rod which extends between the actuating part of that blocking unit which has associated therewith one of the edge-side pull-out furniture parts and the stop, all blocking rods being displaceable together with the actuating parts which lie in between.

A retraction spring, which acts upon a respective catch arm, is tensioned stronger in the end position of the catch arm than in the initial position of the catch arm. When the catch arm is pivoted from its initial position into its end position, a dead point of the retraction spring is preferably overcome. The catch arm is consequently held by the retraction spring in its end position once the driver, which interacts with the catch arm, has uncoupled from the catch arm when the pull-out furniture part is pulled out.

In an advantageous manner, a respective catch arm is rotatably mounted by a stationary (=rigidly connected or connectable to the furniture body) support unit of the respective blocking unit which also rotatably mounts at least one of the blocking rods. In a favorable manner, a respective support unit, to this end, comprises a hollow space which completely runs through the support unit in the direction of the longitudinal axes of the blocking rods, that is in the direction of the pivot axis of the catch arm. This hollow space receives in each case a portion of at least one of the blocking rods. A particularly compact design is made possible in this way. In a favorable manner, the catch arm is rotatably mounted on at least one surface of the support unit that surrounds the hollow space.

In an advantageous embodiment of the invention, the pull-out blocking device includes a damping device for damping the insertion of a respective pull-out furniture part, the pivoting of the catch arm from the end position into the initial position being damped by said damping device. In a particularly preferred embodiment, said damping device includes at least one rotary damper or is formed by one such rotary damper, the rotary damper comprising at least one part which is driven by the catch arm when the catch arm is pivoted from the end position thereof into the initial position thereof and is rotated about the stationary pivot axis of the catch arm in relation to a fixed part for exerting a braking force when the catch arm is pivoted from the end position thereof into the initial position thereof. An advantageous, very compact design of a retraction blocking device with an incorporated damped self-closing mechanism can be achieved as a result, a design that is suitable for high loads also being made possible.

In addition to the pull-out furniture parts for which the pull-out blocking device is used, the furniture item on which the pull-out blocking device is used can additionally comprise one or several further pull-out furniture parts which are not coupled with the pull-out blocking device and which can therefore be pulled out independently of whether another pull-out furniture part of the furniture item has already been pulled out.

BRIEF DESCRIPTION OF THE DRAWINGS

Further advantages and details of the invention are explained below by way of the accompanying drawing, in which:

FIGS. 21 and 22 show schematic representations of an alternative design variant for the actuation of the blocking rods; and FIGS. 23 and 24 show representations corresponding to FIGS. 21 and 22 but without the actuating sleeve.

DETAILED DESCRIPTION OF THE PREFERRED EMBODIMENTS

Figure 2:
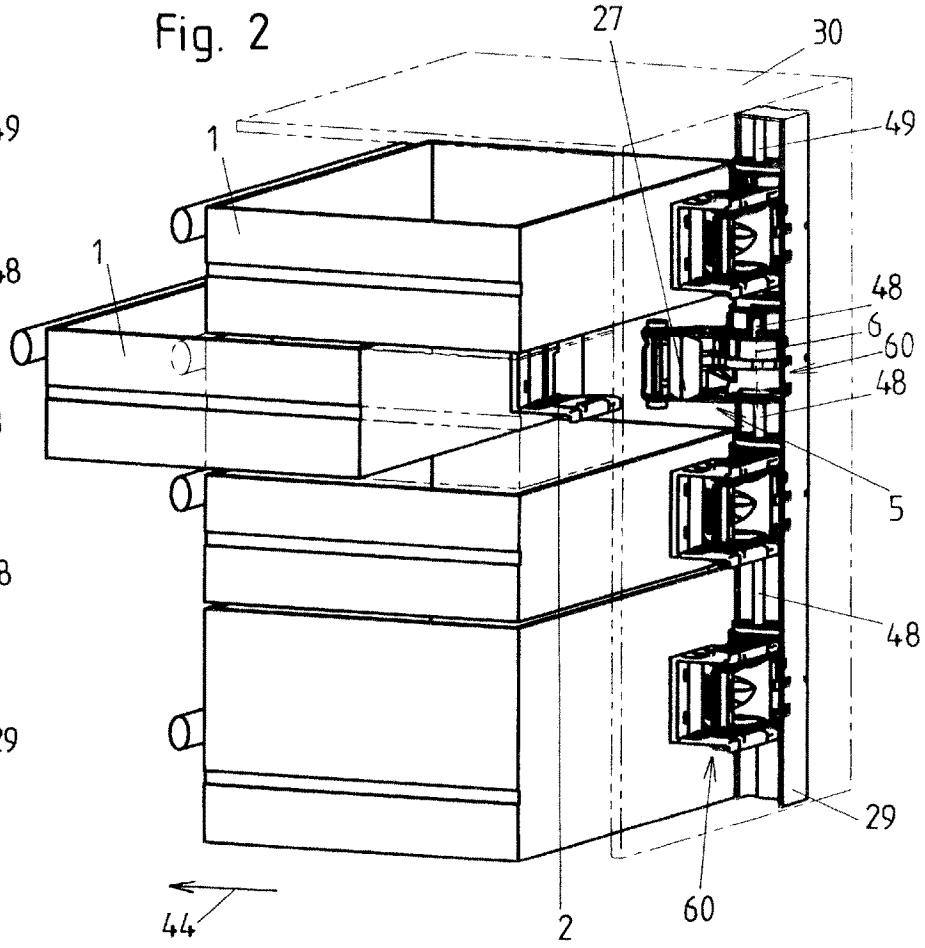
FIG. 2 shows a perspective view corresponding to FIG. 1, but one of the pull-out furniture parts has been pulled out.

One exemplary embodiment of a device according to the invention is shown in FIGS. 1 to 20. The device serves here to realize a pull-out blocking device for pull-out furniture parts 1 which are realized in the form of drawers. A device according to the invention can also be realized as a pull-out blocking device for other types of pull-out furniture parts, e.g. for larder pull-outs.

The pull-out furniture parts 1 can be pulled out of the furniture body 30 (indicated in FIGS. 1 and 2 by the broken lines) in a pull-out direction 44 by means of pull-out guides which are not shown in the Figures and can be retracted into the furniture body 30 in an opposite direction to the pull-out direction 44. On the rear side (with reference to the pull-out direction 44) of a respective pull-out furniture part 1, there is mounted thereon a driver 2 which is consequently entrained with the pull-out furniture part when said pull-out furniture part 1 is pulled out and retracted.

For each of the pull-out furniture parts 1, the device includes a respective blocking unit 60, i.e. there is an own (=separate) blocking unit 60 present for each of the furniture parts (incorporated in the pull-out blocking device). In the exemplary embodiment, the blocking units 60 are mounted on a mounting rail 29 which is fastened on the furniture body 30. Direct fastening of the respective blocking unit 60 on the furniture body 30 would also be conceivable and possible.

Each of the blocking units 60 comprises a catch arm 5 which is mounted so as to be pivotable about a stationary pivot axis 6 (=fixed with reference to the furniture body 30). A respective catch arm 5 interacts with the associated driver 2, in the exemplary embodiment shown as a result of sliding paths 3 which are realized on the driver 2 and projections 4 which are arranged on the catch arm and are formed by rollers. The driver 2, in this connection, is realized in a U-shaped manner and, on opposite side cheeks 2*a*, 2*b* which protrude on both sides from a connecting leg 2*c*, has the opposite sliding paths 3 which interact with the two projections 4. It could also be possible to provide one single sliding path 3 which interacts with a projection 4 of the driver 2. The at least one projection could also be formed by a journal. A reverse design is also possible where at least one sliding path 3 is provided on the catch arm 5 and at least one projection 4 on the driver 2.

In the completely retracted state of a respective furniture part of the pull-out furniture parts 1, the respectively associated catch arm 5 assumes its initial position. When one of the pull-out furniture parts 1 is pulled out, the associated catch arm 5 is pivoted in the direction of rotation 26*a* about the pivot axis 6 until it reaches its end position. In said position of the catch arm 5, the driver 2 uncouples from the catch arm 5. As a result, the pull-out furniture part 1 can be pulled out further until it reaches its completely pulled-out position. When the pull-out furniture part 1 is inserted in the opposite direction to the pull-out direction 44, the driver 2 runs up to the catch arm 5 which is situated in its end position. These two parts are then reciprocally coupled and the catch arm 5 is rotated back in the opposite direction of rotation 26*b* about the pivot axis 6 until the catch arm 5 assumes the initial position again and the pull-out furniture part 1 assumes its completely retracted position.

It is also possible to realize driver connections in another form, for example a recess which is realized in a substantially V-shaped manner into which a projection enters in order to adjust the catch arm 5 by the driver 2 between the initial position and the end position and back. Different types of possible driver connections are known, for example, from conventional pull-out furniture parts with retracting mechanisms.

With the catch arm 5 coupled with the driver 2, there is a positive locking connection between said two parts with reference to the pull-out direction 44 and the opposite insertion direction.

Figure 1:
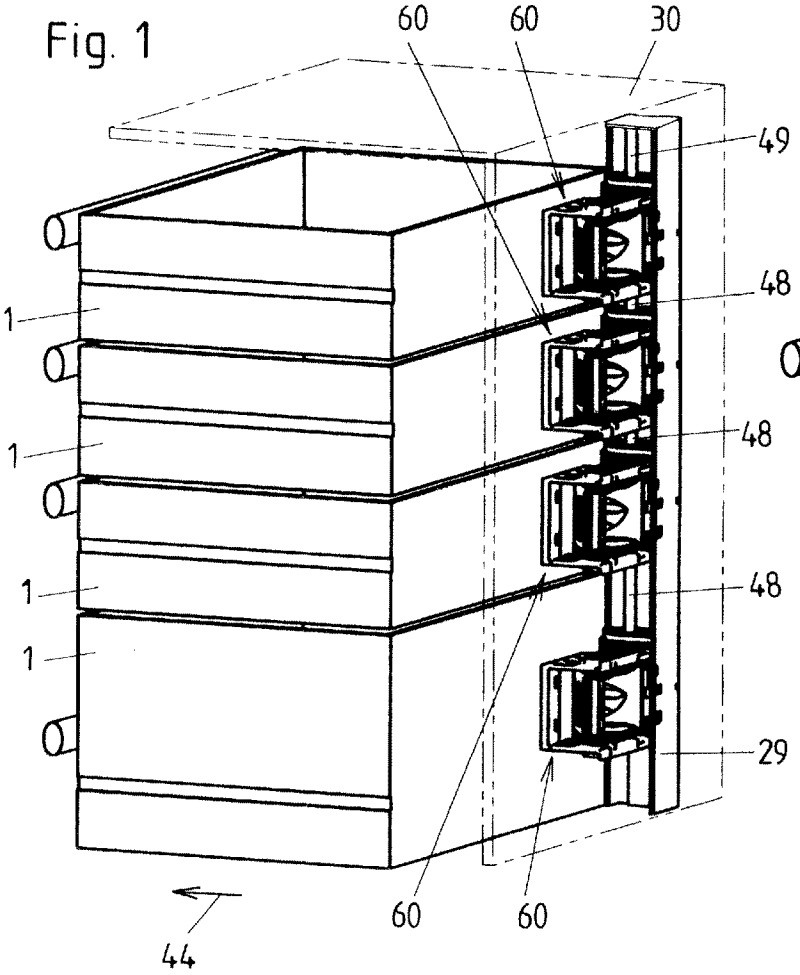
FIG. 1 shows a perspective view of a pull-out blocking device according to the invention in the state mounted on an item of furniture, all pull-out furniture parts have been retracted.
Figure 4:
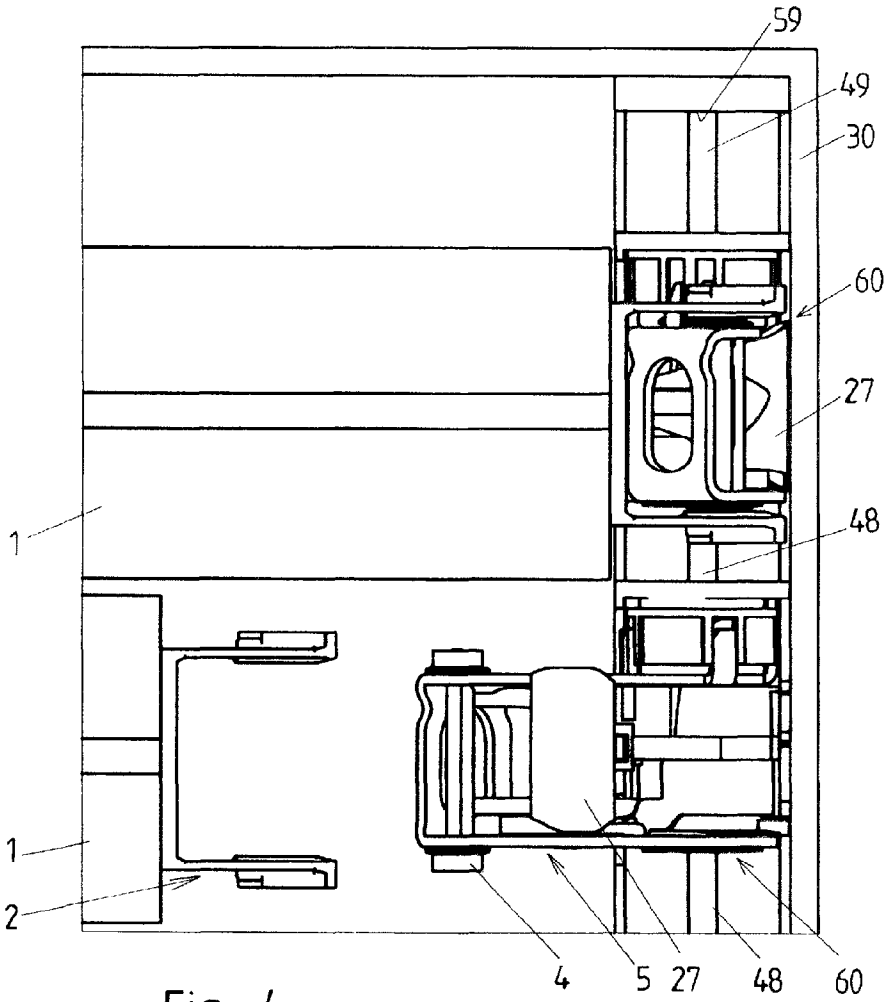
FIG. 4 shows a side view corresponding to FIG. 3, but in the state of FIG. 2.
Figure 3:
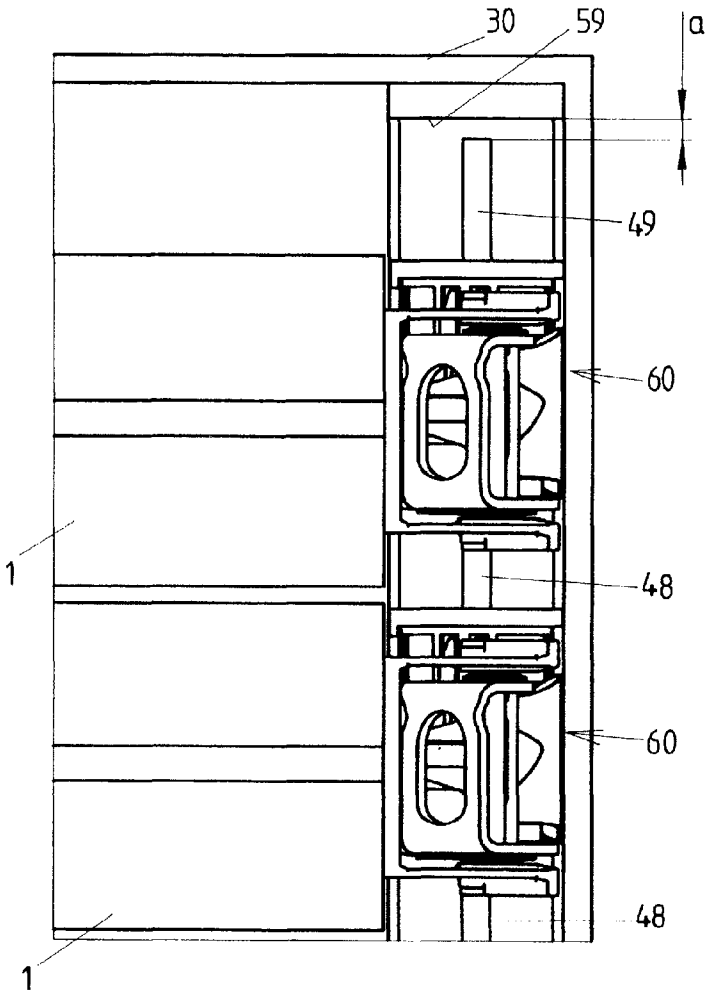
FIG. 3 shows a side view of part of the device in the state of FIG. 1.
Figure 6:
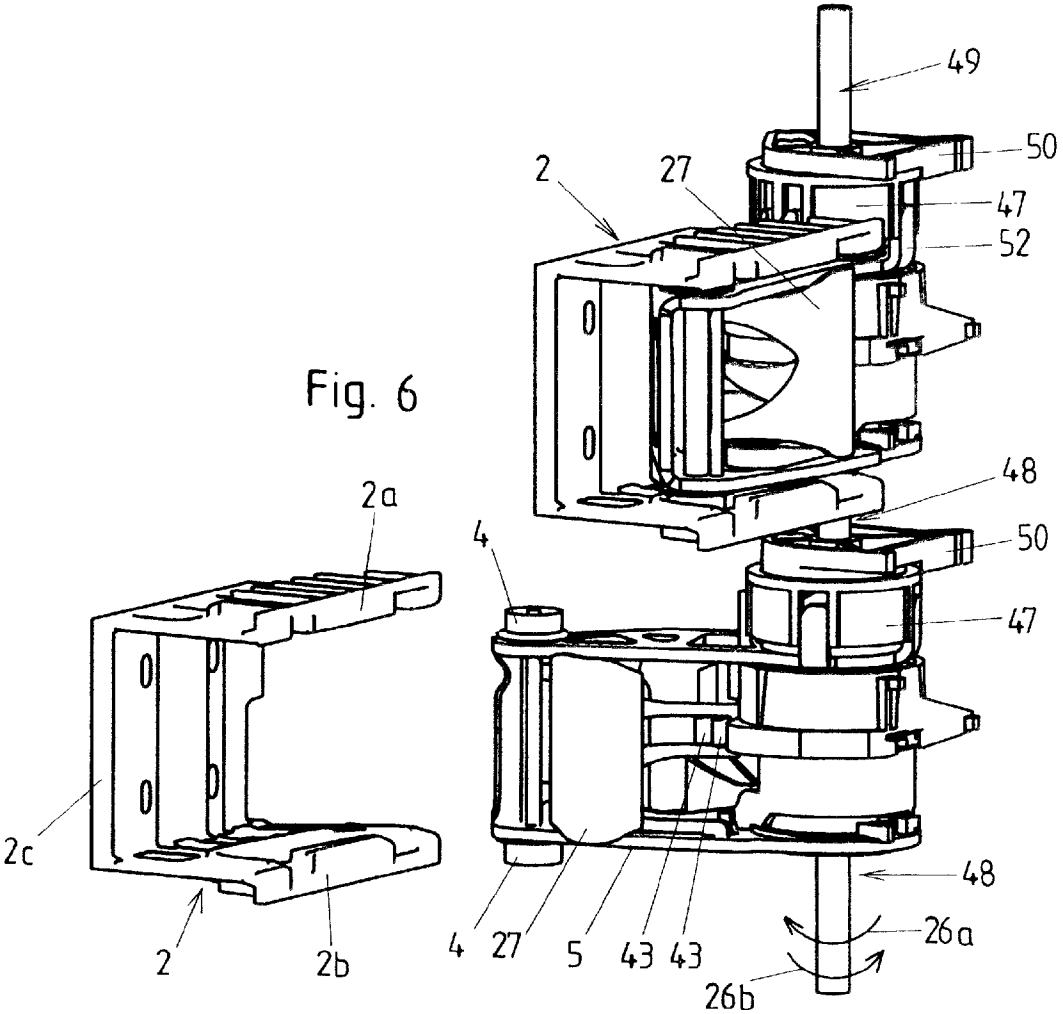
FIG. 6 shows a perspective view corresponding to FIG. 5, but in the state of FIG. 2.
Figure 5:
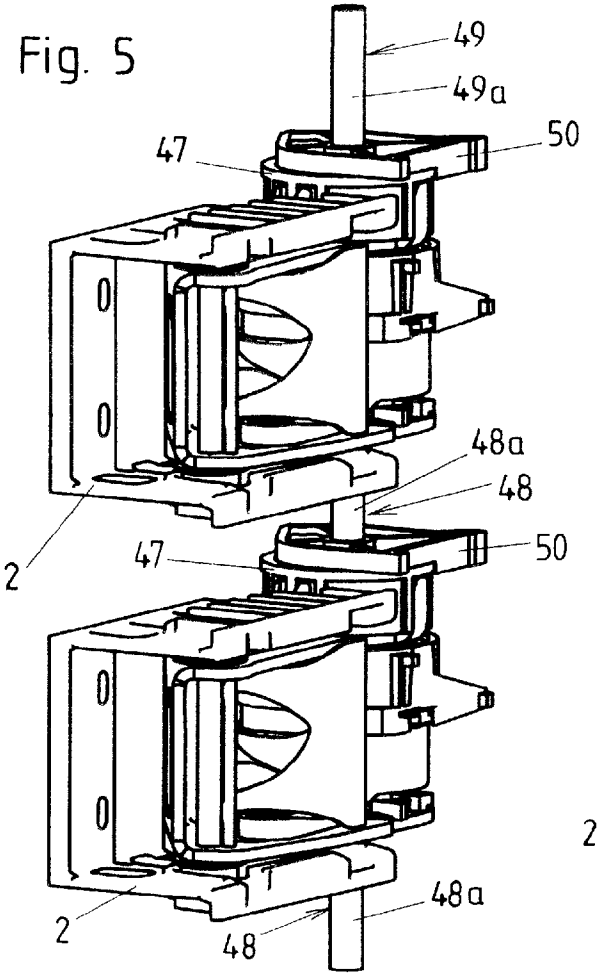
FIG. 5 shows a perspective view of the two topmost blocking units with the drivers which interact with them as well as blocking rods, in the state of FIG. 1.

FIG. 1 shows the state in which all the pull-out furniture parts 1 assume their completely retracted position. FIG. 2 shows the state in which one of the pull-out furniture parts 1 is pulled out at least so far that the driver 2 has uncoupled from the catch arm 5 and the catch arm 5 is situated in its end position. The catch arms 5, in this connection, are coupled in such a manner that a pivoting of the other catch arms 5 situated in their initial positions about the pivot axis 6 in the direction of their end positions is blocked. The other pull-out furniture parts 1 are consequently blocked in their completely retracted positions. One of the other pull-out furniture parts 1 cannot be pulled out until the pulled-out furniture part 1 has been retracted again. This coupling of the catch arms 5, by means of which always only one of the pull-out furniture parts 1 can be pulled out at the same time (i.e. the pull-out furniture parts 1 can be pulled out alternately), is explained in more detail further below.

Refraction devices for the pull-out furniture parts 1 which are coupled together by means of the pull-out blocking device are incorporated in the pull-out blocking device according to the invention. When it is retracted, a respective pull-out furniture part of the pull-out furniture parts 1 is automatically retracted over a last portion of its retraction path by means of said retraction devices.

To this end, a retraction spring 27 cooperates with the catch arm 5 at the one end and at the other end with a part which is arranged so as to be non-displaceable and non-rotatable in relation to the furniture body 30, in the exemplary embodiment the housing part 28. The housing part 28 is connected non-rotatably to the mounting rail 29 which, in turn, is mounted rigidly on the furniture body 30. However, it is possible to assemble the housing part 28 directly on the furniture body 30.

Latching arms 43, between which the inner end (=placed closer to the pivot axis 6) of the retraction spring 27 is able to be latched, can be arranged on the housing part 28 to connect the retraction spring 27 to the housing part 28. When the retraction spring 27 is able to be connected to the housing part 28 at various spacings from the pivot axis 6 by, for example, several latching arms 43 being provided, the strength of the retraction force can be modified as a result of various prestressing of the retraction spring 27. Connection possibilities at various points of the catch arm 5 can also be provided or the spacing from the pivot axis 6 can be continuously modified, e.g. as a result of an eccentric element.

Figure 15:
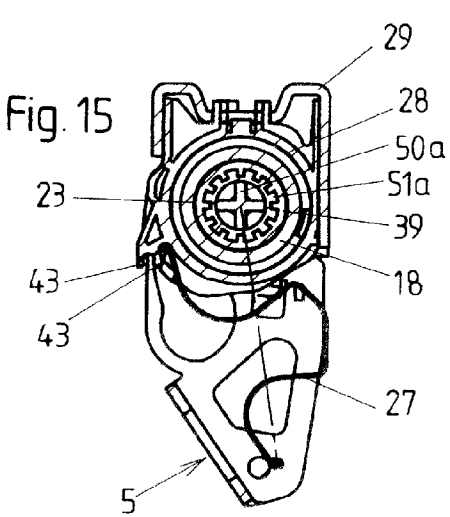
FIGS. 14 and 15 show cross sections of the blocking unit corresponding to FIG. 13, but with the catch arm in different pivot positions.
Figure 14:
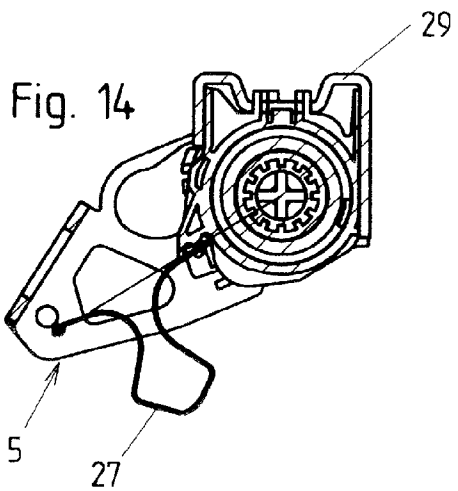
Figure 13:
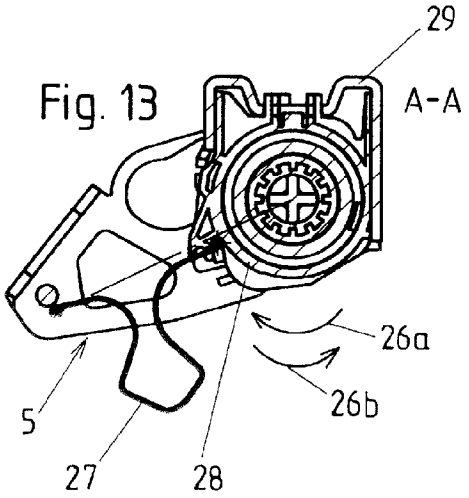
FIG. 13 shows a cross section along the line AA of FIG. 11 or 12.
Figure 16:
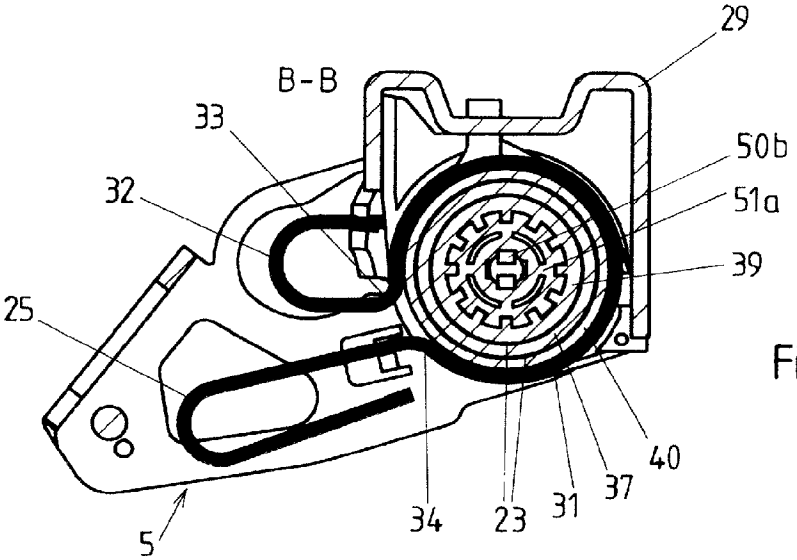
FIG. 16 shows a cross section along the line BB of FIG. 11 or 12.

When, proceeding from its initial position shown in FIG. 15, the catch arm 5 is pivoted in the direction of rotation 26*a* in the direction of its end position, the retraction spring 27 is initially stressed, cf. FIGS. 15 and 14. Shortly before reaching the end position, a dead point is crossed (this is the position shown in FIG. 14), as a result the retraction spring 27 is relaxed again a little (for example, by less than a fifth of the preceding compression stroke) until the end position shown in FIG. 13 is reached.

When, as the pull-out furniture part is pushed in, the driver 2 runs up to the catch arm 5, the driver 2 then pivots the catch arm 5 in the direction of rotation 26*b* over the dead point of the retraction spring 27. In the position of the catch arm 5 in which the dead point of the retraction spring 27 is present, the at least one projection 4 has already entered so far into the at least one sliding path 3 that when the catch arm 5 is pivoted further about the pivot axis 6, brought about by the retraction spring 27, the catch arm 5, with reference to the pull-out direction 44, is connected in a positive locking manner to the driver 2 and the pull-out furniture part 1 is retracted by the catch arm 5 as a result of the force of the retraction spring 27 until the initial position of the catch arm 5 shown in FIG. 15 is reached.

When the catch arm 5 is pivoted in the direction of rotation 26*a*, the catch arm 5 is blocked from pivoting further in said direction 26*a* when the end position is reached as a result of a stop which is formed between the catch arm 5 and a part fixed to the body, for example the mounting rail 29. When the catch arm is pivoted in the reverse direction, a further corresponding stop can be present between the catch arm 5 and a part fixed to the body, for example the mounting rail 29, which, with the catch arm in the initial position, blocks the catch arm from pivoting further in said direction of rotation 26*b*. On the other hand, the further pivoting of the catch arm 5 could also be limited by the boundary of the further displacement of the pull-out furniture part 1 when it reaches its completely retracted position.

The rotation of the catch arm 5 about the pivot axis 6 from the end position thereof into the initial position thereof, that is in the direction of rotation 26*b*, is damped by a damping device which is described further below and is also incorporated in the pull-out blocking device in the exemplary embodiment, as is preferred. When the pull-out furniture part, which is displaced in the opposite direction to the pull-out direction 44, runs up to the catch arm 5, which is situated in its end position, a braking force is consequently exerted on the pull-out furniture part 1. Once the catch arm 5 has been pivoted over the dead point of the retraction spring 27, the pull-out furniture part 1 is refracted against the braking force exerted by the damping device.

Furthermore, the pull-out blocking device includes blocking rods 48, 49 which are actuated by actuating parts 47 of the blocking units 60.

The blocking rods 48 extend in each case between blocking units 60 which are associated with the adjacent pull-out furniture parts 1. An additional blocking rod 49 extends between the blocking unit 60 associated with one of the end-side pull-out furniture parts 1, the uppermost pull-out furniture part 1 in the exemplary embodiment shown, and a stop 59 which is arranged in a stationary manner with respect to the furniture body 30, for example is arranged on the mounting rail 29. Proceeding from the blocking unit 60, the blocking rod 49 extends in a direction which is directed away from the other blocking units 60.

Actuating parts 47 which are realized in another form or which interact with the catch arms 5 are conceivable and possible. An example of another such possible design is explained in more detail below by way of FIGS. 21 to 24.

With all the pull-out furniture parts 1 in the completely retracted position, there is a spacing a between the end of the blocking rod 49 that faces the stop 59 and the stop 59.

The longitudinal axes of all the blocking rods 48, 49 lie parallel to one another and along a common straight line on which the pivot axes 6 also lie, i.e. the longitudinal axes of the blocking rods 48, 49 and the pivot axes 6 coincide.

Apart from the actuating part 47 which is provided for displacing the blocking rod 48 which is placed the furthest away from the stop 59, the actuating parts 47 lie in each case between two of the blocking rods (one between the blocking rods 48, 49, the other between two blocking rods 48) and are arranged so as to be displaceable together with said blocking rods 48, 49. The actuating part 47, which, when one of the pull-out furniture parts 1 is pulled out, is adjusted by the catch arm 5 which is pivoted when said pull-out furniture part 1 is pulled out, displaces all the blocking rods 48, 49 which lie closer to the stop 59, when viewed from said actuating part, together with the actuating parts 47 lying in between.

In the exemplary embodiment a respective actuating part 47 is realized in the form of a cam disk and is connected non-rotatably to the catch arm 5 of the respective blocking unit 60. The actuating part 47, in this connection, can be displaced in relation to the catch arm 5 in the direction of the pivot axis 6 by a limited path section, it nevertheless remaining non-rotatably connected to the catch arm 5. For example, for this purpose the catch arm 5 can comprise claws 52 which, as shown, extend in the direction of the pivot axis 6 and engage in recesses 53 of the actuating part 47. On the bottom ends of rod parts 48*a*, the blocking rods 48 comprise in each case one non-rotatably held cam follower part 50 (e.g. as a result of being supported against the mounting rail 29). On the top ends of the rod parts 48*a* the blocking rods 48 comprise in each case one non-rotatably held cam follower part 51 (in the exemplary embodiment said cam follower part comprises webs which project radially hereto, extend in the axial direction and engage in indentations which extend in the axial direction on the inner braking part 10). A cam follower part 50 which is non-rotatably held (e.g. as a result of being supported against the mounting rail 29) is arranged on the end of the rod part 49*a* of the blocking rod 49 facing the blocking unit 60.

Figure 8:
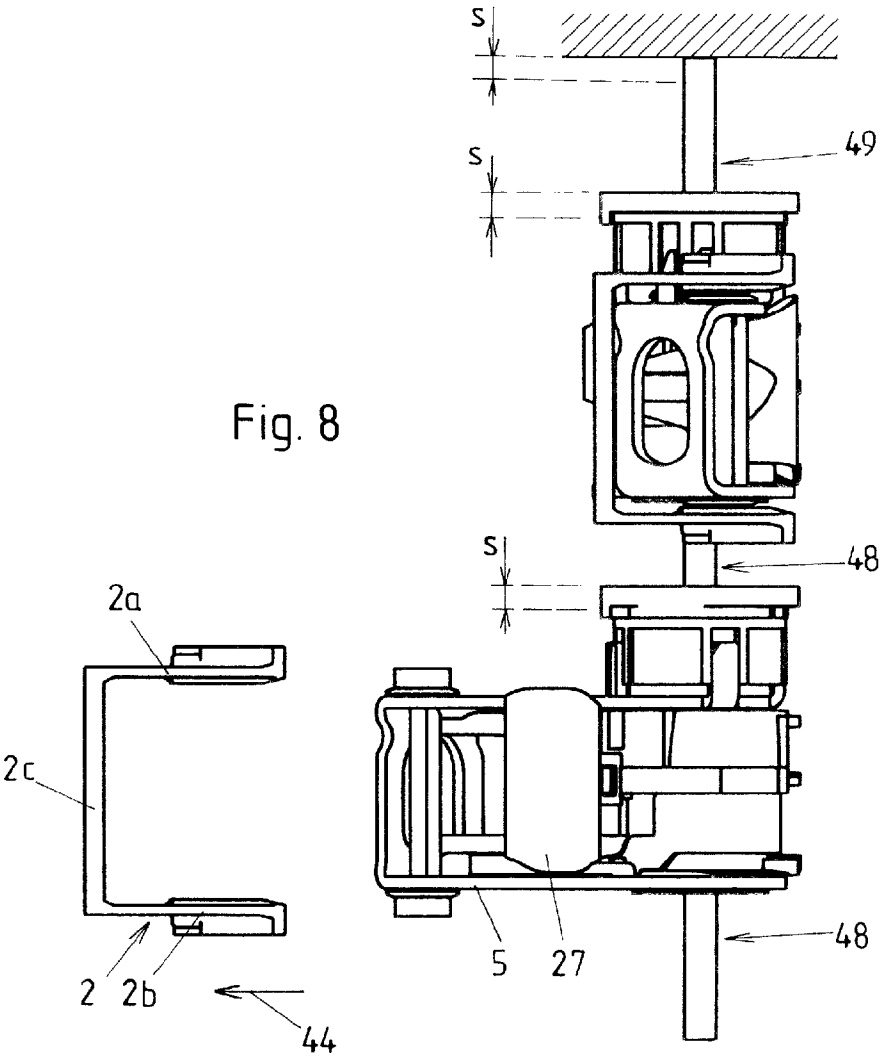
FIGS. 7 and 8 show representations corresponding to FIG. 5 and FIG. 6, but in a side view, with additional schematic indication of the stop for the blocking rods.
Figure 7:
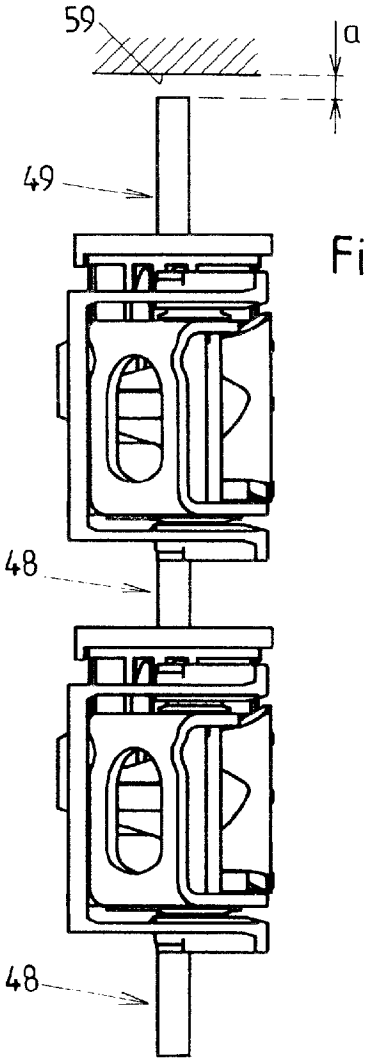
Figure 9:
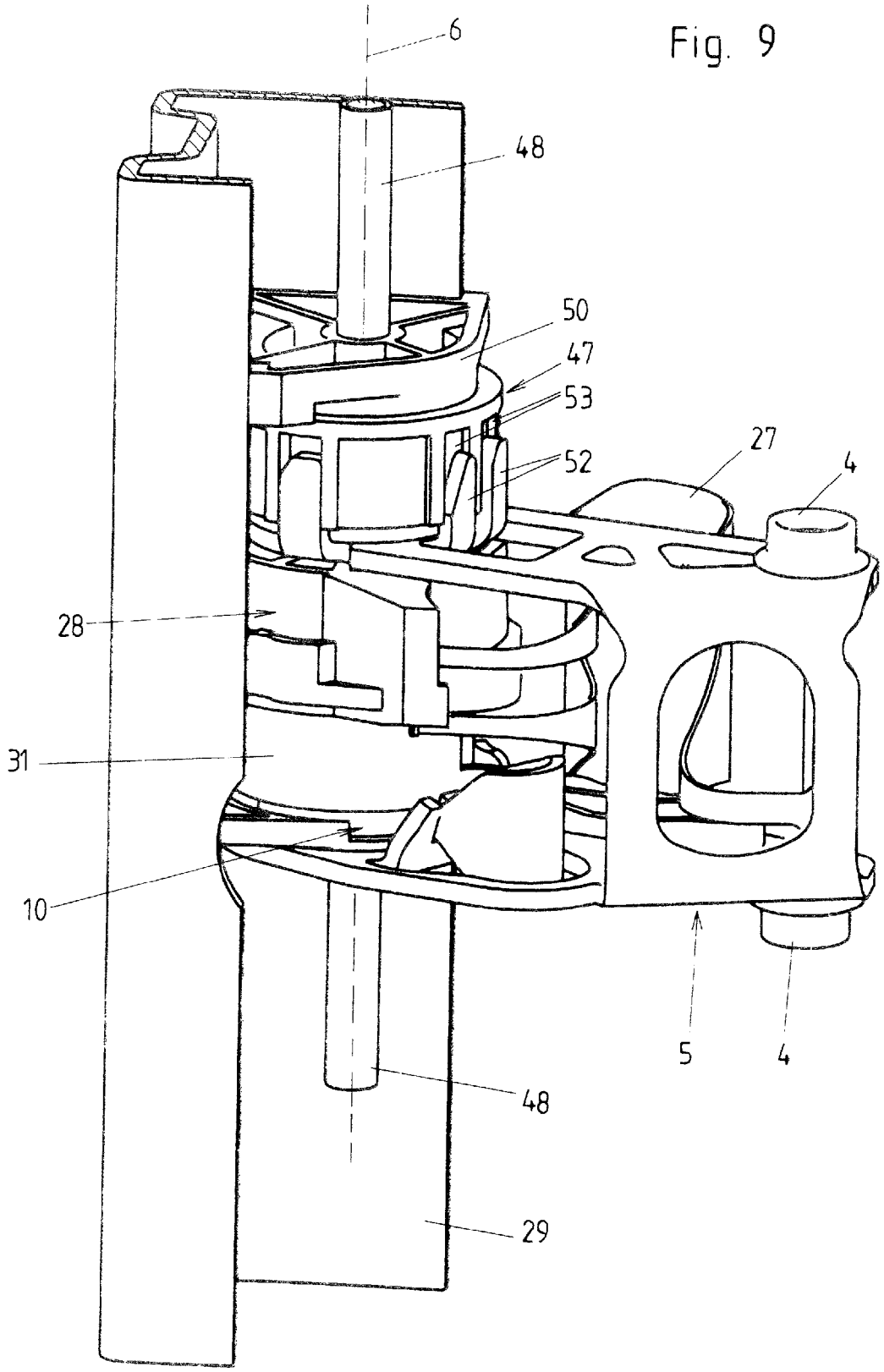
FIG. 9 shows a perspective view of one of the pull-out blocking units with the blocking rods which interact with them in the state mounted on a mounting rail, from a direction of view that differs to that of FIGS. 5 and 6.
Figures 10, 10A:
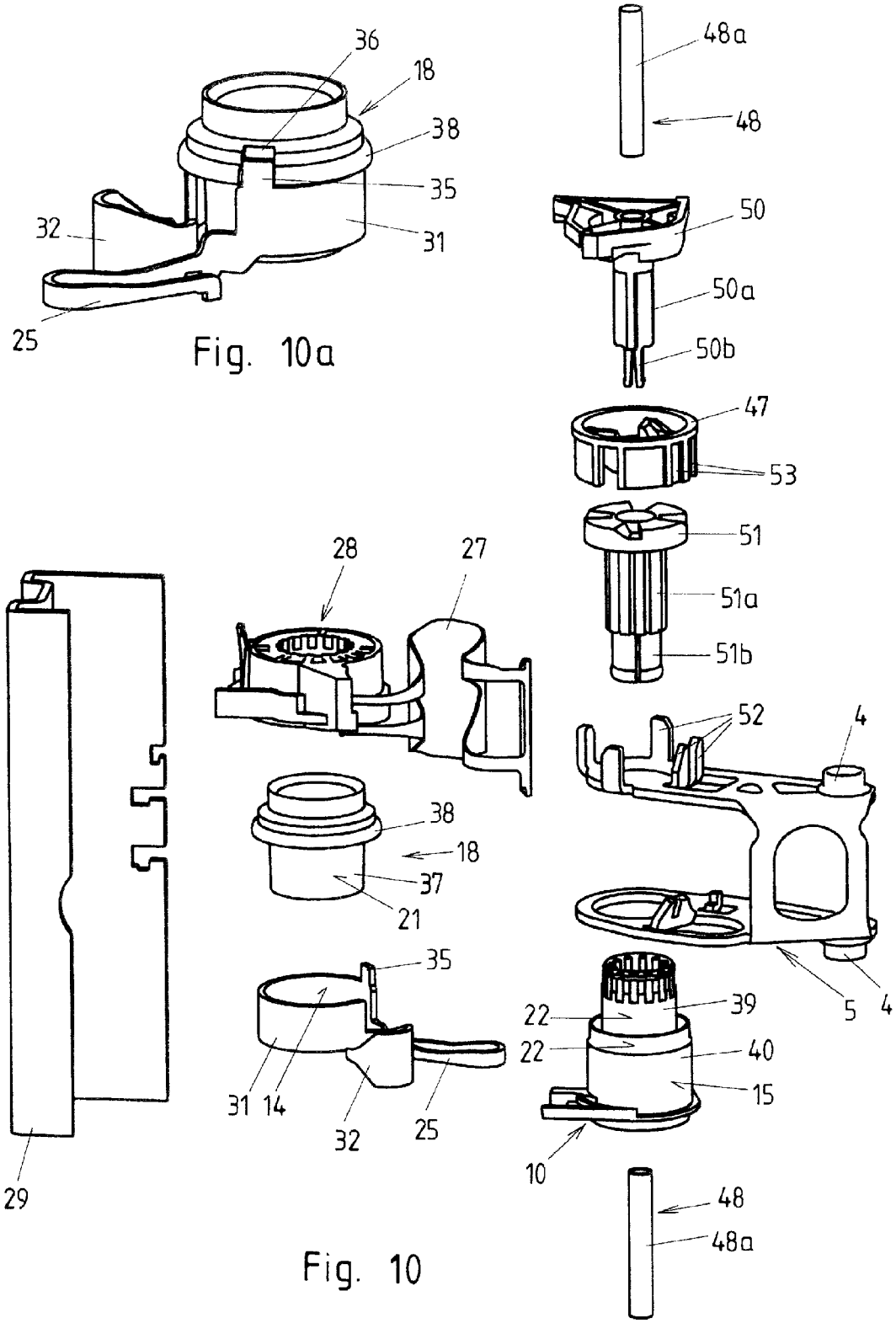
FIG. 10 shows an exploded representation of the parts of FIG. 9.
FIG. 10*a* shows a perspective view of the wraparound part which engages with the damper sleeve from a direction of view that differs to that of FIG. 10.
Figure 12:
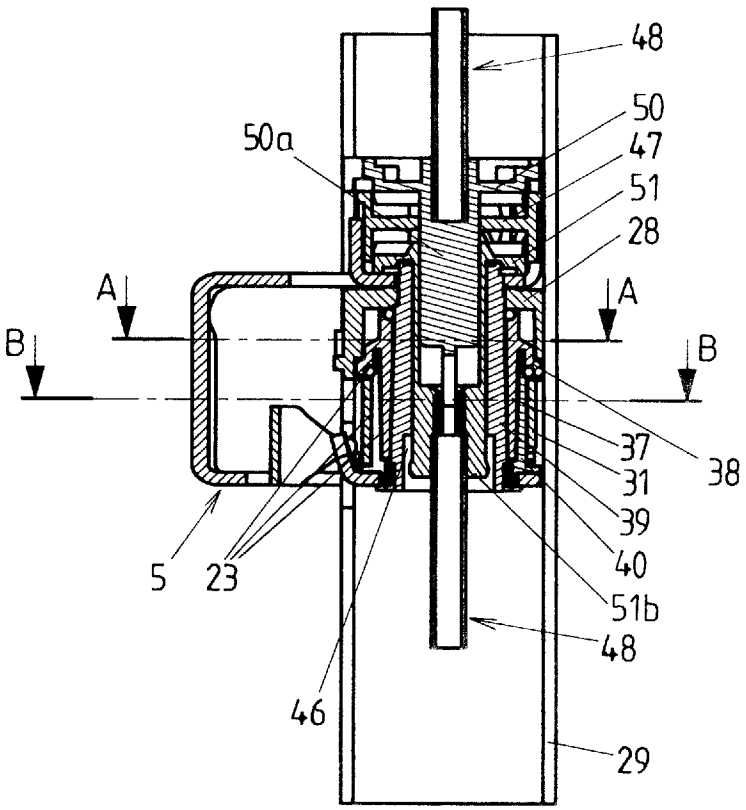
FIG. 12 shows a representation corresponding to FIG. 11, but in a longitudinal central section of the blocking unit.
Figure 11:
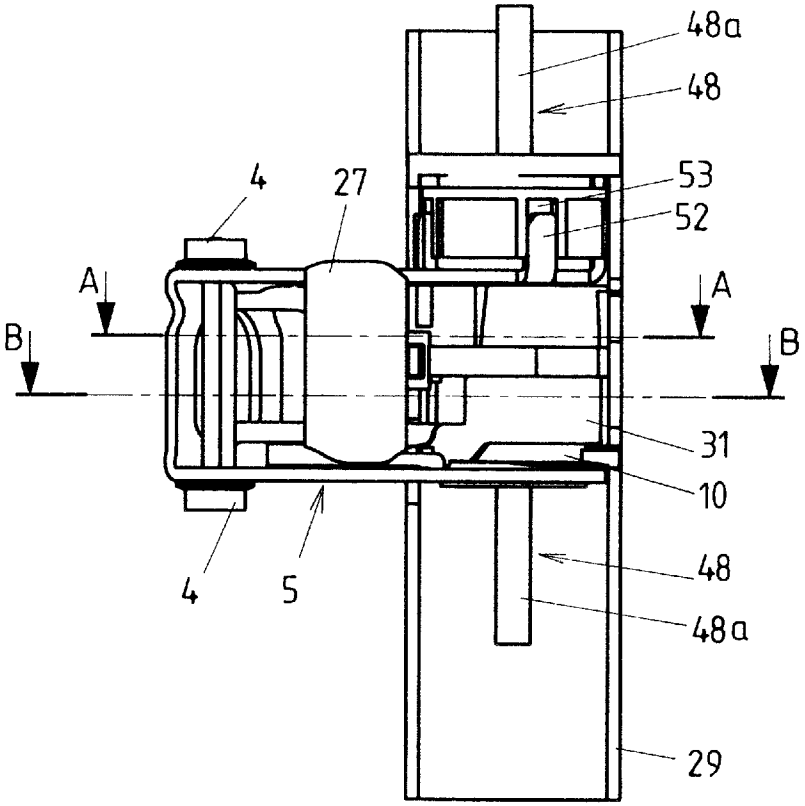
FIG. 11 shows a side view of the parts of FIG. 9.

If one of the pull-out furniture parts 1 is pulled out, as a result of the pivoting of the catch arm 5 of the associated blocking unit 60 from the initial position thereof into the end position thereof, the actuating part 47 of said blocking unit 60 is adjusted from a first into a second position, as a result of which the blocking rod 48, 49, which interacts with said actuating part 47 and extends from said actuating part 47 in the direction toward the stop 59, is displaced by the actuating part 47. If this is the actuating part 47 which interacts with the blocking rod 49, only the blocking rod 49 is displaced in the direction toward the stop 59 until the play present is essentially used up (the spacing a, cf. FIG. 7, has reduced to less than a fifth of the initial value). If a different pull-out furniture part of the pull-out furniture parts 1 is pulled out, all the blocking rods 48, 49 which lie between the actuating part 47 and the stop 59 and the actuating parts 47 which lie between the blocking rods 48, 49 are displaced in the direction toward the stop by the actuating part 47 of the associated blocking unit 60. FIG. 8 indicates the section of displacement s at three points (which is at least four fifths of the initial value of the spacing a).

Once one of the pull-out furniture parts 1 has been pulled out, it is consequently no longer possible to displace the blocking rods 48, 49 and the actuating parts 47 which lie between them any further. The catch arms 5 of the other pull-out furniture parts 1 are consequently blocked in their initial positions such that a displacement of the associated drivers 2 in the pull-out direction 44 is blocked.

When retracting the pulled-out pull-out furniture part 1, the associated catch arm 5 is adjusted from its end position into its initial position and said catch arm adjusts the actuating part 47 of said blocking unit 60 from the second position back into the first position, as a result of which the spacing a between the blocking rod 49 and the stop 59 is produced again.

The actuating part 47 which is associated with the end, remote from the stop 59, of the blocking rod 48 placed the furthest away from the stop 59 is also arranged in the exemplary embodiment shown so as to be displaceable in the direction of the longitudinal axes of the blocking rods 48, 49 so that said blocking unit 60 is realized identically to the others. The displaceability of said actuating part 47 in the direction of the longitudinal axes of the blocking rods 48, 49 can, however, be omitted.

In the exemplary embodiment shown, the pull-out furniture parts 1 are arranged one above another and when one of the pull-out furniture parts 1 is pulled out, the blocking rod 48, 49, which extends upward from the actuating part 47 associated with said pull-out furniture part 1, and all the blocking rods 48, 49, where applicable, lying above it and actuating parts 47 lying in between are displaced upward. In order to support the resetting of the parts when the pull-out furniture part 1 is retracted, a spring could be provided between the stop 59 and the blocking rod 49. Displacement of the blocking rods 48, 49 and actuating parts 47 lying in between downward is also conceivable and possible, the stop 59 being arranged below the blocking unit 60 which is associated with the bottom-most pull-out furniture part 1 and the blocking rod 49 extending between said blocking unit 60 and the stop 59. In addition, the pull-out furniture parts 1 could also be arranged side by side, the longitudinal axes of the blocking rods 48, 49 and the pivot axes 6 then extending horizontally. In principle, arrangements of the blocking rods 48, 49 and of the pivot axes 6 which are inclined in relation to the horizontal are also conceivable and possible.

Depending on the dimensions of the pull-out furniture parts 1 in the direction of the longitudinal axes of the blocking rods 48, 49, it is possible to use blocking rods 48, 49 of different lengths (the lengths of the individual blocking rods 48, in this connection, can also differ from one another, as is also shown in the Figures).

Figure 18:
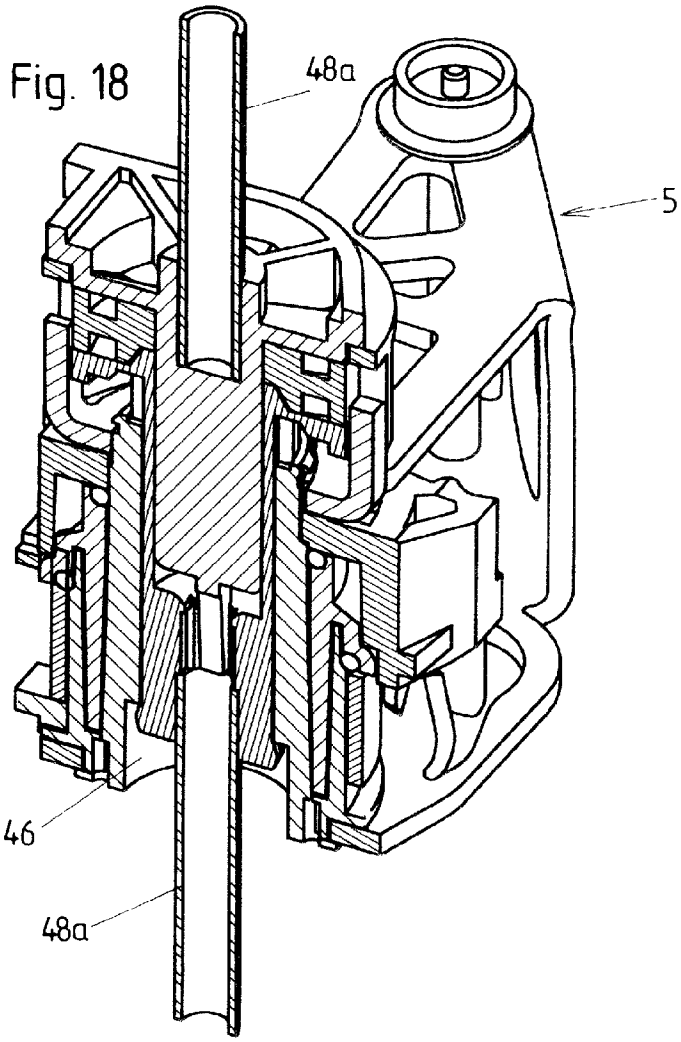
FIG. 18 shows a representation corresponding to FIG. 17, in contrast to FIG. 17, however, one of the pull-out furniture parts located below having been pulled out.
Figure 17:
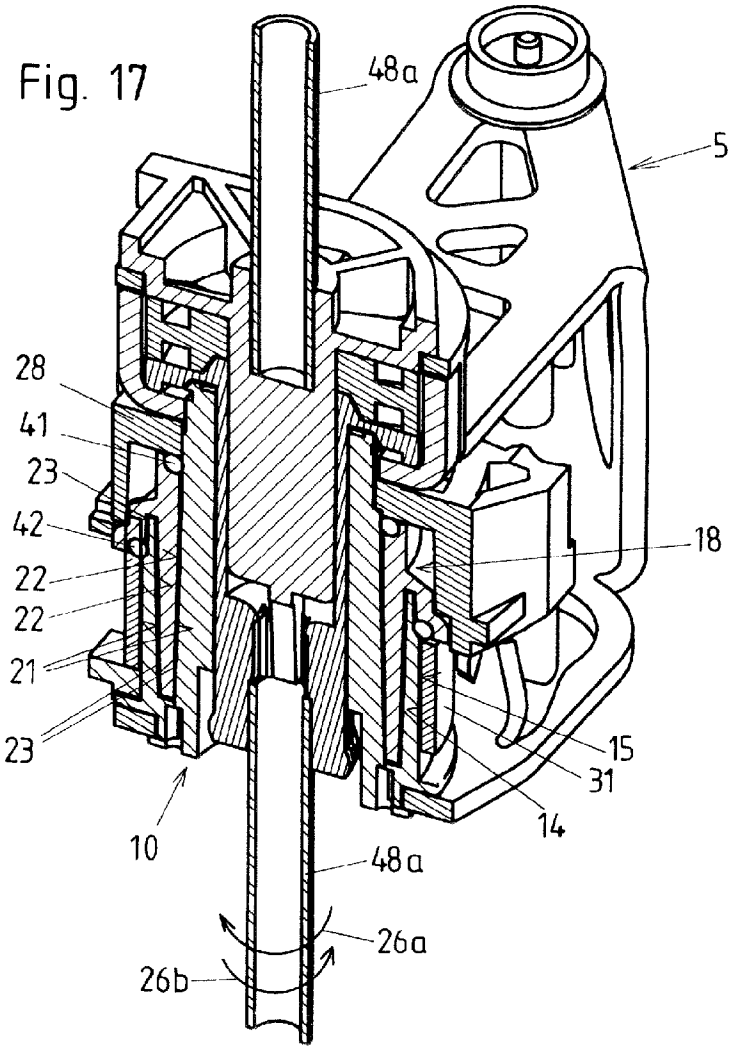
FIG. 17 shows a perspective view, cut open in the longitudinal central section, of the blocking unit with the blocking rods which interact with it, with the catch arm in the initial position.
Figure 19:
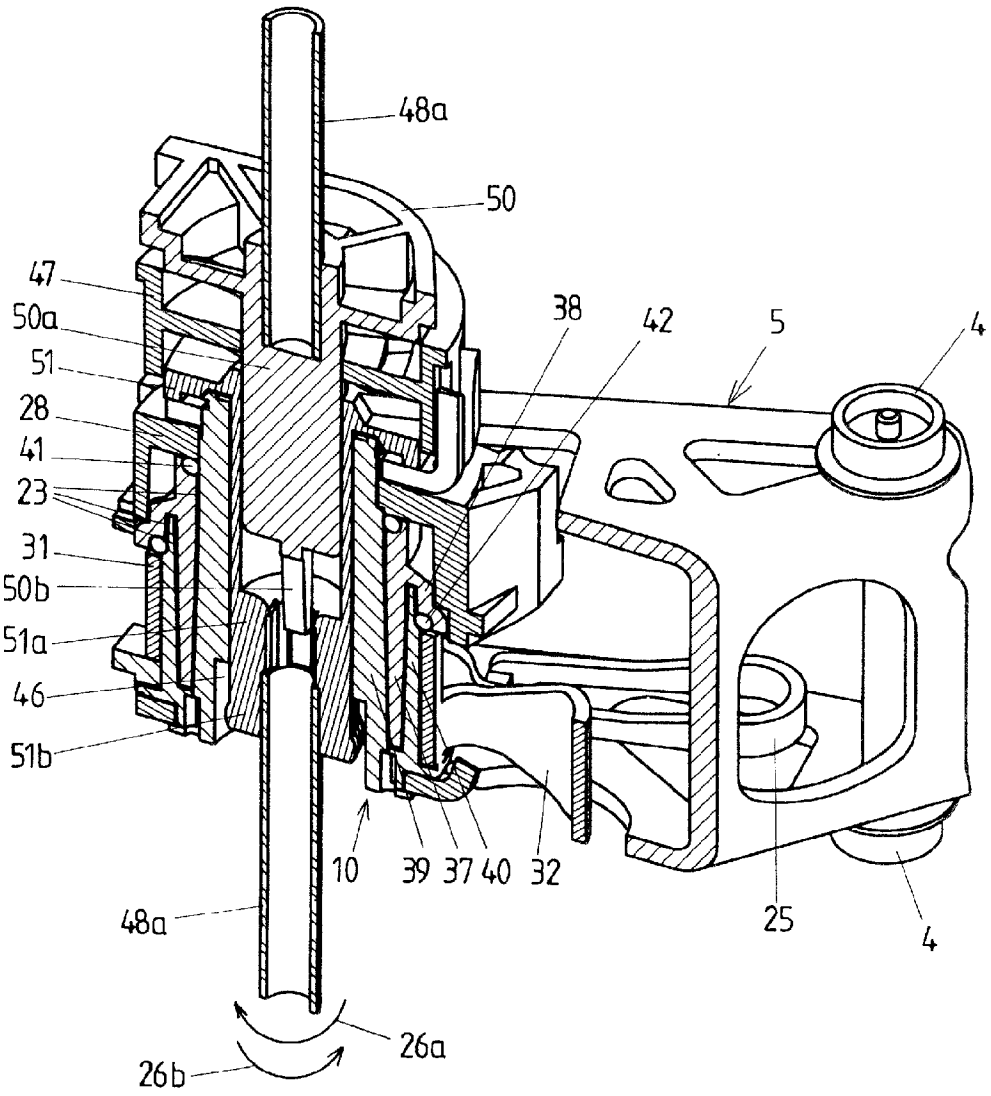
FIG. 19 shows a representation corresponding to FIG. 17, but with the catch arm in the end position.

FIGS. 17 and 18 compare the positions of a blocking unit 60 when the associated pull-out furniture part 1 is retracted, in FIG. 17 the pull-out furniture parts which are associated with blocking units which are further away from the stop 59 also being retracted, whilst in FIG. 18 one of said pull-out furniture parts is pulled out. FIG. 19 shows the state in the pulled-out position of the associated pull-out furniture part 1.

If desired, central locking can also be realized (not shown in the Figures). To this end, with all the pull-out furniture parts in the completely retracted position, a locking part can be inserted into the space between the blocking rod 49 and the stop 59, said locking part blocking displacement of the blocking rods 48, 49 and of the actuating parts 47 lying in between in the direction toward the stop 59.

The catch arm 5 is mounted so as to be pivotable about the axis of rotation 9 by a stationary support unit, the catch arm 5 being held so as to be non-displaceable in the direction of the pivot axis 6 of the catch arm 5. In the exemplary embodiment, the stationary support unit is formed by the housing part 28 and an inner braking part 10, on which the housing part 28 is placed. In the exemplary embodiment, the stationary support unit is non-rotatably connected to the mounting rail 29 which, in turn, is fastened on the furniture body 30. The fastening on the mounting rail 29 is preferably effected by latching projections of the housing part 28 and of the inner braking part 10 which engage in recesses in the mounting rail 29. It is also conceivable and possible to omit the mounting rail 29 and to fasten directly on the furniture body 30.

The stationary support units mount the blocking rods so as to be displaceable in their axial directions. To this end, they have a hollow space 46 which runs through them completely and extends in the direction of the pivot axis 6. Portions of the blocking rods 48 are accommodated by said hollow spaces. Guides for the axial displacements of the blocking rods 48 are also realized as a result.

For the pivotable bearing arrangement of the catch arm 5, in the exemplary embodiment said catch arm is rotatably mounted on the surfaces of the stationary support unit surrounding the hollow space 46.

The cam follower part 50 has an axial continuation 50*a* with latching tongues 50*b*. The cam follower part 51 has an axial continuation 51*a* with latching tongues 51*b*. The cam follower part 51 can be inserted into the hollow space 46 by way of the continuation 51*a* and the cam follower part 50 can be inserted through a central opening of the actuating part 47 into a central opening of the cam follower part 51 by way of the continuation 50*a*. As a result of the latching tongues 50*b*, 51*b*, the parts are held together to facilitate assembly prior to the assembly of the device, the necessary ranges of movement being maintained after the assembly.

In the exemplary embodiment shown, the damping device includes a first mechanically operating braking apparatus with two parts rotated in relation to one another about the pivot axis 6 (=first rotary damper) and one second braking apparatus which is coupled with said first braking apparatus, the braking force of which is produced by a viscous damping medium which is arranged in a gap between two parts which are rotated in relation to another about the pivot axis 6 (=second rotary damper). As a result of the coupling of the braking devices, pressing of the friction faces of the first braking apparatus is mutually dependent on the braking force exerted by the second braking device. As a result, an overall speed-dependent damping action is achieved, the braking force of the damping device increasing as the speed increases.

The catch arm 5 is connected to a pre-formed wraparound part 31 which is, however, flexible as a result of its elasticity such that, when the catch arm 5 rotates about the pivot axis 6 in the direction of rotation 26*b*, the wraparound part 31 is also rotated about the pivot axis 6. In the exemplary embodiment, the wraparound part 31 is formed by a band and extends for a large part of the periphery of the inner brake part 10 around said brake part. The inner surface (=facing the axis 6) of the wraparound part 31 forms a driven friction face 14 which, to generate a braking force, interacts with the outer surface (=directed away from the axis 6) of the inner brake part 10 which forms a fixed friction face 15 (in the exemplary embodiment this is the bottom portion of the wall 40). The driven friction face 14 and the fixed friction face 15 form the friction pairing of the first, mechanically operating braking apparatus which includes the wraparound part 31 and the inner brake part 10.

The connection between the catch arm 5 and the wraparound part 31 is effected by means of an overload spring 32 which, in the exemplary embodiment shown, is realized integrally with the wraparound part 31 and is formed by a portion, comprising spring elasticity and extending in the shape of an arc or a loop, of the band which forms both the wraparound part 31 and the overload spring 32. In other embodiments, an overload spring can also be realized in another manner or can also be omitted.

The transition between the wraparound part 31 and the overload spring 32 can be viewed as the front connecting point 33 of the wraparound part 31, at which the movement of the pull-out furniture part 1 to be damped is introduced into the wraparound part 31.

The wraparound part 31 is connected to the damper sleeve 18 at a rear connecting point 34. In this connection, in the exemplary embodiment shown, an axial projection 35 of the wraparound part 31 is inserted into an indentation 36 of the damper sleeve 18, cf. FIG. 10*a*. Other designs of the driving connection are possible.

Between the front connecting point 33 and the rear connecting point 34 the wraparound part 31 extends around the inner brake part 10 (in the direction of rotation 26*a*) over more than 90°, preferably over more than 180°, particularly preferred over more than 250° with reference to the pivot axis 6. In the exemplary embodiment shown, said extension is less than 360°. An extension of more than 360° is possible, i.e. the wraparound part then comprises more than one whole turn, extending in a helical manner about the inner brake part 10.

The rear connecting point 34 of the wraparound part 31 is connected to the catch arm 5 by means of a hold-open spring 25. Said hold-open spring 25, in said exemplary embodiment, is realized integrally with the wraparound part 31 and is formed by an arcuate or loop-shaped portion of the band which also realizes the wraparound part 31 and, where applicable, the overload spring 32. The hold-open spring 25 could also be formed by a separate part or could also be omitted.

The overload spring 32 is substantially harder, preferably more than 10 times harder than the hold-open spring 25.

The damper sleeve 18, in said exemplary embodiment, comprises a wall 37 which engages in a slot between an inner and an outer wall 39, 40 of the inner brake part 10. In addition, the damper sleeve 18 comprises a wall 38 which engages over an upper portion of the outer wall 40 of the inner brake part 10. The inside and outside faces of the wall 37 of the damper sleeve 18 and the inside face of the wall 38 of the damper sleeve 18 form driven damper faces 21. The outside face of the wall 39 of the inner brake part 10, the inside face of the wall 40 of the inner brake part 10 and the upper portion of the outside face of the wall 40 of the inner brake part 10 form fixed damper faces (the lower portion of the wall 40 forms the fixed friction face 15). A ring-shaped gap, in which a viscous damping medium 23 is arranged, is situated in each case between the driven damper faces 21 and the fixed damper faces 22. Sealing rings 41, 42 define the gap between the outside face of the wall 39 and the inside face of the wall 37 at the upper end and the gap between the upper portion of the outside face of the wall 40 and the inside face of the wall 38 at its lower end such that a sealed space is realized. Free-flowing oil can consequently be used as damping medium. However, the use of non-free-flowing grease is also possible.

The second braking apparatus consequently includes the damper sleeve 18, the inner brake part 10 and the damping medium 23.

As a result of rotating the catch arm 5 about the pivot axis 6, the wraparound part 31 is rotated about the pivot axis 6, as a result of which the damper sleeve 18 is rotated about the pivot axis 6 as a result of the connection between the wraparound part 31 and said damper sleeve. Depending on the speed of the rotation of the damper sleeve 18 about the pivot axis 6, the second braking apparatus exerts a more or less large braking force, as a result of which a more or less large tensile force acts between the front connecting point 33 and the rear connecting point 34 of the wraparound part 31. Depending on the size of said tensile force, the driven friction face 14 is pressed against the fixed friction face 15 in a more or less strong manner.

In the idle state of the device, the wraparound part 31, in an advantageous manner, comprises a spacing, at least in portions, from the fixed friction face 15. On account of its pre-forming in the idle state, the wraparound part 31 preferably comprises a spacing from the friction face 15 of the inner brake part 10 over at least substantially the entire course of its friction face 14, i.e. at least over 90% of its extension in the circumferential direction.

As a result of the hold-open spring 25 which acts upon the rear connecting point 33 of the wraparound part 31 in relation to the front connecting point 33 of the wraparound part 31 or in relation to the catch arm 5 in the direction of rotation 26*b*, the friction face 14 of the wraparound part 31 is then spaced from the friction face 15 of the inner brake part 10 (at least for the most part) up to a limit value of the speed of the pull-out furniture part 1 or a limit value of the speed of rotation of the catch arm 5 and the first braking apparatus is substantially inoperative (i.e. its braking action is in any case smaller than the braking action of the second braking device). The first braking apparatus does not become operative until said limit value is exceeded.

At a high speed at which the pull-out furniture part 1 contacts the catch arm 5, without the overload spring 32 the device would suddenly be subject to a high braking force, as a result of which undesirably high loads and undesirably severe braking of the pull-out furniture part 1 would follow. As a result of the overload spring 32, the peak of the braking force is cushioned by the catch arm 5 being able to rotate in relation to the wraparound part 31 with deforming of the overload spring 32.

As the speed of the retraction against the braking force exerted by the braking device, where applicable after damping the initially faster speed of the pull-out furniture part 1 when running up against the catch arm, is relatively slow, the retraction spring 27 essentially only has to overcome the relatively low braking force of the second braking device. The force of the refraction spring 27 can consequently be designed to be relatively slight, which facilitates the pulling out of the pull-out furniture part 1.

When the catch arm 5 is rotated back in the direction of rotation 26*a*, the damper sleeve 18 is rotated by the catch arm 5 by means of the hold-open spring 25 such that the force which is to be overcome in this connection must be exerted. Said force is comparably slight as the first braking apparatus is not operative in said direction of rotation. If, however, applying such a force is not desired, a free running state, which is closed in the direction of rotation 26*b* and opens in the opposite direction of rotation 26*a*, can be provided between a part which is connected to the wraparound part 31, where applicable by means of the hold-open spring 25 and/or the overload spring 32, and the catch arm 5. Such free running states are known, also in conjunction with dampers.

In an embodiment which is modified in relation to the embodiment shown, the catch arm 5 could also be mounted so as to be pivotable on the damper sleeve 18, about an axis of rotation which is parallel to the pivot axis 6. The connection of the wraparound part 31 or of the overload spring 32 which is connected to the wraparound part 31 could then be effected on the catch arm 5 radially outside said axis of rotation. As a result of a resetting spring the catch arm 5 could be urged into an initial position with reference to its axis of rotation in relation to the damper sleeve 18. When damping the movement of the pull-out furniture part 1, when the catch arm 5 is pivoted about the axis of rotation in a more or less manner against the force of the spring urging it, since the rotation of the axis of rotation about the pivot axis 6 is braked by the braking force of the second braking device, the wraparound part 31 is tightened in a more or less manner and pressed against the fixed friction face 15. The retraction spring 27 would have to be arranged, in turn, between the catch arm 5 and a part fixed to the body, for example the housing part 28. The actuating part 47 would then have to be coupled in another way with the catch arm 5, for example by means of the damper sleeve 18 which, when rotated, adjusts the actuating part 47 directly or by means of at least one transmission member.

Instead of a band, the wraparound part 31 can also be formed by a wire, in particular spring wire, or a flexible cord. In an expedient manner, the angle of wrap of the wire or the flexible cord is between 90° and 530°, preferably between 180° and 500°, an angle of wrap of between 250° and 330° being particularly preferred.

In an expedient manner, the friction pairing or at least one of the friction pairings of the first braking apparatus has a coefficient of kinetic friction of at least 0.2, preferably at least 0.3.

In an advantageous manner, the viscosity of the viscous damping medium of the second braking apparatus is in excess of 20,000 Pa s, preferably in excess of 50,000 Pa s, values within the range of between 100,000 and 1,000,000 Pa s being particularly preferred.

The clearance of the gap or at least one of the gaps, preferably all of the gaps, in which the damping medium is arranged, is in an advantageous manner within the range of between 0.1 mm and 0.5 mm, i.e. the damping medium comprises such a film thickness.

Figure 20:
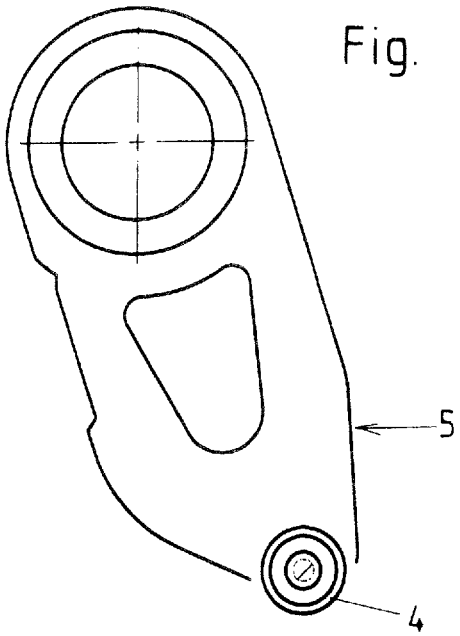
FIG. 20 shows a representation to explain the retraction movement of the projections of the catch arm into the sliding paths of the driver.
Figure 20:
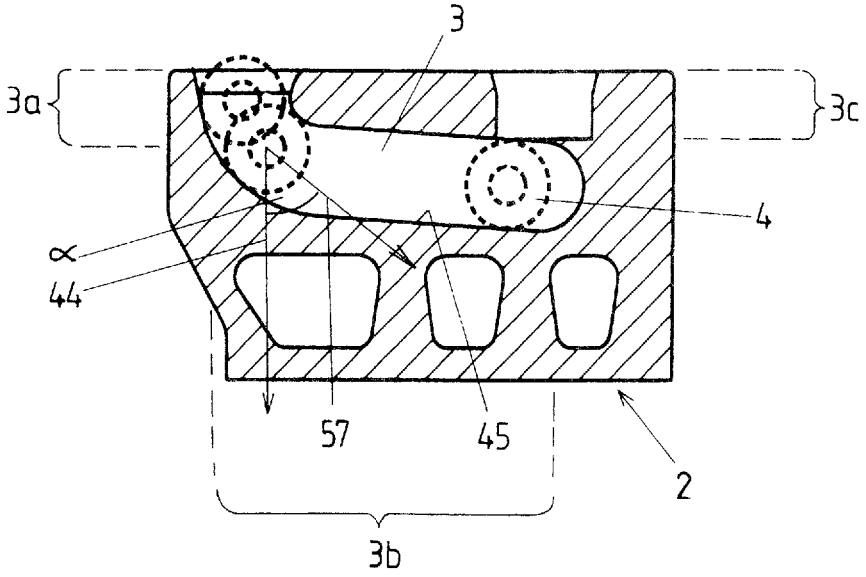

FIG. 20 shows one of the projections 4 of the retraction lever 5 moving into the associated sliding path 3 of the driver 2 when the pull-out furniture part 1 is closed. The curved sliding path 3 (the course of both sliding paths 3 is identical) has an initial portion 3*a*, at the start of which the projection 4, from outside the sliding path 3, moves into the sliding path 3. The sliding path 3 guides the projection 4 over the initial portion 3*a* in a direction 57 which encloses an angle $\alpha$ of less than 30° with the pull-out direction 44. The angle $\alpha$, in this connection, increases continuously from the start of the initial portion 3*a*, where said angle $\alpha$ is preferably less than 20°, in a particularly preferred manner is less than 15°, up to the end of the initial portion 3*a*. The end of the initial portion 3*a* and the start of a continuing portion 3*b* of the sliding path 3 therefore lie at the point where said angle $\alpha$ reaches the value of 30°. This angle $\alpha$ continues to increase over the continuing portion 3*b* until it is at least in excess of 45°, in the exemplary embodiment shown it is between 80° and 90°. FIG. 20 shows the angle $\alpha$ for a position of the projection 4 inside the continuing portion 3*b* in which the angle $\alpha$ is somewhat in excess of 45°.

In the exemplary embodiment shown, as soon as it has reached its maximum value the angle $\alpha$ is constant up to the end of the continuing portion 3*b*. A curved design of the sliding path 3 at the end of the continuing portion 3*b* which is remote from the initial portion 3*a* is also possible in other exemplary embodiments.

The projection 4 is consequently guided by the sliding path 3 at least over part of the initial portion of the sliding path 3 which follows the start of the initial portion 3*a* at an angle of less than 20°, preferably less than 15° to the pull-out direction 44. At least over part of the continuing portion 3*b*, the projection 4 is guided by the sliding path 3 preferably in a direction which encloses an angle of in excess of 70°, preferably in excess of 80° with the pull-out direction 44.

FIG. 20 shows by way of broken lines three positions of the projection 4 when moving into the sliding path 3. The first position just shows the first run up of the projection 4 to the side wall 45 of the sliding path 3, as a result of which the retraction lever 5 is pivoted over the dead point (said side wall 45 is then, in the continuation portion 3*b*, the side wall of the sliding path 3 which lies at the back with reference to the direction of insertion of the furniture part 1 which is opposite to the pull-out direction 44). Here, the angle α is less than 20°, preferably less than 10°. In the second position, the projection 4 is already situated in the continuing portion 3*b*, the angle α here being just in excess of 45°. In the third position shown, the projection 4 is situated in the continuing portion 3*b* at the point which it assumes with the pull-out furniture part in the completely inserted state, the angle α here in the exemplary embodiment being between 80° and 90°. The side wall 45 extends in each case in the direction in which the projection 4 is guided by the sliding path 3 such that the angle which the side wall 45 encloses in each case with the pull-out direction 44 corresponds to the angle α between the direction of the guiding of the projection 4 and the pull-out direction 44.

The force necessary to actuate the catch arm 5 when inserting the pull-out furniture part 1 can be influenced as a result of the described curved course of the at least one sliding path 3. In particular, a type of speed ratio is produced as a result of the course of the initial portion 3*a*. As a result, when the pull-out furniture part 1 approaches the catch arm 5 at a certain speed, at the start of the run up when the projection 4 is situated in the region of the inlet portion 3*a* of the sliding path 3, the damping force which acts on the pull-out furniture part 1 is reduced. In addition, as a result, the dead point of the retraction spring 27 (if such is present) can be overcome by a lesser force to be applied by the pull-out furniture part 1.

In addition, a self-sealing portion 3*c* of the sliding path 3 proceeds from FIG. 20. As a result of said self-sealing portion, the respective projection 4 can move into the continuing portion 3*b* when the driver 2, when the pull-out furniture part is pushed in, is to run up to the retraction lever 5 which is situated in its initial position. The self-sealing portion extends at least substantially parallel (i.e. there is a deviation of less than 15°) to the pull-out direction 44. The self-sealing portions 3*c* are widened toward their open ends as a result of run-in inclinations. So that the projections 4 are able to move in through the self-sealing portions 3*c*, the projections 4, however, not being able to move out of the continuing portions 3*b* through the self-sealing portions 3*c*, it is possible to utilize the elasticities of the components (such that the projection 4, with the pull-out furniture part 1 in the retracted state, lies offset with respect to the self-sealing portion 3*c* as in FIG. 20). For example, when the projections 4 move in through the self-sealing portions 3*c*, steps could also be traveled over, the side cheeks 2*a*, 2*b* which comprise the sliding paths 3 being pressed apart from one another. In addition to this or instead of it, additional resilient latching elements arranged on the driver 2 could be provided.

The actuation of the blocking rods 48, 49 could also be effected in another manner. One such further possible design is shown in FIGS. 21 to 24. In this case, the actuating part 47 is realized in the form of a cam part which is pivotable about a pivot axis 54 which lies at right angles to the pivot axis 6. The actuating part 47, in this connection, interacts with the end of the at least one adjoining blocking rod 48, 49 or with a part which is connected to said blocking rod in order to displace the blocking rod 48, 49 in the respective direction parallel to the pivot axis 6 when it is pivoted about the pivot axis 54.

The actuating part 47 comprises an actuating arm 47*a* which projects radially from the pivot axis 54 and is connected to a sleeve 55 which is rotatable about the pivot axis 6. When the sleeve 55 is rotated about the pivot axis 6, the actuating part 47 is pivoted about the pivot axis 45. Limited displacement in the direction of the pivot axis 6 is possible between the sleeve 55 and the actuating arm 47*a*, for example as a result of designing in a fork-shaped manner the end of the actuating arm 47*a* in which a journal 56 which is mounted on the sleeve 55 engages.

The sleeve 55 can be connected to the catch arm 5 or to another part which is rotated about the pivot axis 6 when the catch arm 5 is rotated about the pivot axis 6, for example to the damper sleeve 18. An integral design with the catch arm 5 or with the part which is rotated about the pivot axis 6, for example the damper sleeve 18, is also possible.

In principle, arrangements of the blocking rods 48, 49 and of the pivot axis 6 which are inclined in relation to the horizontal are also conceivable and possible.

A curved leaf spring is provided as the retraction spring in the Figures described beforehand. Refraction springs which are realized in another manner can also be provided. For example, leg springs (with a desired number of turns between the two end-side legs) or helical springs could be used. A curved leaf spring which is larger in width in a central region than in the end-side connecting regions could also be provided. The curvature, in this connection, could extend in a direction other than the one shown (for example upward or downward).

The damping device could also be realized in a manner other than the one described. Thus, it could also be possible to provide in place of the described wraparound part a type of wrapping unit which is formed by two or more rigid jaw parts which are connected together in an articulated manner and surround the inner brake part at least over a large part of its periphery. The catch arm 5 could be mounted on an end-side, with reference to the direction of rotation about the pivot axis 6, jaw part (which lies at the front with reference to the direction of rotation 26*b*), as a result of which the catch arm 5 could be mounted so as to be pivotable about the pivot axis 6. The damper sleeve 18 could be non-rotatably connected to a jaw part which lies at the back with reference to the direction of rotation 26*b*. As a result of the braking action which is exerted by the viscous damper medium on the damper sleeve, the jaw parts are pressed together in a more or less manner and are pressed against the inner brake part 10.

Damping devices with only one single braking device, for example with a viscous damping medium in a gap between a driven and a fixed part can also be provided if the braking force obtained as a result is sufficient.

Although mounting the driver 2 on the rear side of the pull-out furniture part 1 will be advantageous in many applications, it is also possible for it to be mounted on the pull-out furniture part 1 in another manner, for example laterally.

The driver could also be secured on a mounting rail of a pull-out guide for the pull-out furniture part, said mounting rail being fixed to the body and mounted on the pull-out furniture part 1.

The blocking rods 48 and/or 49 could be formed of several separate rod parts which can be connected together or, only abutting against one another, are guided in each case so as to be displaceable in the direction of the longitudinal axis of the blocking rod. The rod parts, in this connection, can be realized in particular so as to be the same length. Where there are different spacings between the pull-out furniture parts 1, different numbers of such rod parts could then be used in each case.

In the exemplary embodiment shown, all the pull-out furniture parts of the furniture item are incorporated in the pull-out blocking device. However, designs are also possible where the furniture item additionally comprises at least one pull-out furniture part which can be pulled out irrespective of whether one of the other pull-out furniture parts of the furniture item has already been pulled out. Such a pull-out furniture part which is independent of the other pull-out furniture parts is frequently the uppermost of several drawers which can have a small stowage volume and consequently a low possible weight loaded, e.g. a drawer for writing materials.

In the case of a furniture part which cannot be pulled out by means of the pull-out blocking device, it is possible to use in place of a blocking unit 60 a unit which does not comprise an actuating part 47, but can otherwise be realized in an identical or at least analogous manner to the blocking unit 60. Such a unit comprises, therefore, a stationary support unit which has a hollow space which runs through it completely corresponding to the hollow space 46. One of the blocking rods 48 or 49 can extend through said hollow space. Consequently it is possible to realize the self-closing and the damping function with the same parts, but to remove one or several pull-out furniture parts of the furniture item from the blocking function of the pull-out blocking device.

| Key to the reference numerals: | |
|---|---|
| 1 | Pull-out furniture part |
| 2 | Driver |
| 2a | Side cheek |
| 2b | Side cheek |
| 2c | Connecting leg |
| 3 | Sliding path |
| 3a | Initial portion |
| 3b | Continuing portion |
| 3c | Self-sealing portion |
| 4 | Projection |
| 5 | Catch arm |
| 6 | Pivot axis |
| 10 | Inner brake part |
| 14 | Driven friction face |
| 15 | Fixed friction face |
| 18 | Damper sleeve |
| 21 | Driven damper face |
| 22 | Fixed damper face |
| 23 | Damping medium |
| 25 | Hold-open spring |
| 26a | Direction of rotation |
| 26b | Direction of rotation |
| 27 | Retraction spring |
| 28 | Housing part |
| 29 | Mounting rail |
| 30 | Furniture body |
| 31 | Wraparound part |
| 32 | Overload spring |
| 33 | Front connecting point |
| 34 | Rear connecting point |
| 35 | Projection |
| 36 | Indentation |
| 37 | Wall |
| 38 | Wall |
| 39 | Wall |
| 40 | Wall |
| 41 | Sealing ring |
| 42 | Sealing ring |

-continued

| Key to the reference numerals: | |
|---|---|
| 43 | Latching arm |
| 44 | Pull-out direction |
| 45 | Side wall |
| 46 | Hollow space |
| 47 | Actuating part |
| 47a | Actuating arm |
| 48 | Blocking rod |
| 48a | Rod part |
| 49 | Blocking rod |
| 49a | Rod part |
| 50 | Cam follower part |
| 50a | Continuation |
| 50b | Latching tongue |
| 51 | Cam follower part |
| 51a | Continuation |
| 51b | Latching tongue |
| 52 | Claw |
| 53 | Recess |
| 54 | Pivot axis |
| 55 | Sleeve |
| 56 | Journal |
| 57 | Direction |
| 59 | Stop |
| 60 | Blocking unit |

The invention claimed is:

1. A pull-out blocking device for at least two pull-out furniture parts which can be pulled out from a furniture body in a pull-out direction from a completely retracted position into a completely pulled-out position and can be retracted into the furniture body in an opposite direction to the pull-out direction, said pull-out blocking device comprising, for each of the pull-out furniture parts, a driver which is displaced in the pull-out direction when the pull-out furniture part is pulled out and in the opposite direction to the pull-out direction when the pull-out furniture part is retracted, for each of the pull-out furniture parts, a blocking unit which comprises an actuating part, which is adjusted as a result of a movement of the driver when one of the pull-out furniture parts is pulled out and retracted, and a retraction spring by which the respectively associated pull-out furniture part is retractable over a last portion of a retraction path covered during retraction into the furniture body, blocking rods which interact with the actuating parts and are mounted so as to be displaceable in a direction of longitudinal axes thereof, wherein a respective one of the actuating parts, which is adjusted as a result of the movement of the driver associated therewith when the associated pull-out furniture part is pulled out, displaces at least one of the blocking rods in the direction of the longitudinal axis thereof and, as a result, the blocking rods are blocked against further axial displacement by a stop, each of the blocking units comprises a catch arm mounted so as to be pivotable about a stationary pivot axis that lies parallel to the longitudinal axes of the blocking rods, that is acted upon by the retraction spring of said blocking unit and, when the associated pull-out furniture part is pulled out, is pivoted by the driver associated therewith from an initial position, which the catch arm assumes in the completely retracted position of the pull-out furniture part, into an end position, which the catch arm assumes in the completely pulled-out position of the pull-out furniture part, and in connection with this adjusts the actuating part of said blocking unit.

2. The pull-out blocking device as claimed in claim 1, wherein each of the respective catch arms is rotatably mounted by a stationary support unit, and the blocking rods are displaceably mounted by the stationary support units.

3. The pull-out blocking device as claimed in claim 2, wherein each respective one of the stationary support units comprises a hollow space, which completely runs therethrough parallel to the longitudinal axes of the blocking rods and receives a portion of at least one of the blocking rods.

4. The pull-out blocking device as claimed in claim 3, wherein the catch arm is rotatably mounted on at least one surface of the stationary support unit that surrounds the hollow space.

5. The pull-out blocking device as claimed claim 1, wherein a respective one of the catch arms is held so as to be non-displaceable with reference to a direction parallel to the pivot axis of the catch arm.

6. The pull-out blocking device as claimed in claim 1, wherein when a respective one of the catch arms is pivoted from the initial position thereof into the end position, a dead point of the retraction spring which acts upon the catch arm is overcome, said retraction spring is more strongly tensioned in the end position of the catch arm than in the initial position of the catch arm.

7. The pull-out blocking device as claimed in claim 1, wherein the actuating part of a respective one of the blocking units is rotated about the pivot axis of the catch arm for displacing the at least one blocking rod when the catch arm of said blocking unit is pivoted between the initial position and the end position of the catch arm.

8. The pull-out blocking device as claimed in claim 1, wherein the actuating part of a respective one of the blocking units is rotated about a pivot axis which lies at right angles to the pivot axis of the catch arm for displacing the at least one blocking rod when the catch arm of said blocking unit is pivoted between the initial position and the end position of the catch arm.

9. The pull-out blocking device as claimed in claim 5, wherein the actuating part of a respective one of the blocking units is rotated about the pivot axis of the catch arm for displacing the at least one blocking rod when the catch arm of said blocking unit is pivoted between the initial position and the end position of the catch arm, and the actuating part of a respective one of the blocking units which is coupled with the catch arm is displaceable in relation to the catch arm in the direction of the pivot axis of the catch arm.

10. The pull-out blocking device as claimed in claim 1, wherein a respective one of the blocking units comprises a damping device for damping the retracting of the associated pull-out furniture part, by which the pivoting of the catch arm from the end position thereof into the initial position is damped.

11. The pull-out blocking device as claimed in claim 10, wherein the damping device includes at least one rotary damper or is formed by such a rotary damper which comprises at least one part which is driven by the catch arm when the catch arm is pivoted from the end position thereof into the initial position thereof and is rotated in connection with this movement about the stationary pivot axis of the catch arm in relation to a fixed part for exerting a braking force.

12. The pull-out blocking device as claimed in claim 11, wherein the damping device further comprises a first mechanically acting braking apparatus, which comprises at least one friction pairing where, for generating a braking force, a friction face which is driven by the rotation of the catch arm about the pivot axis of the catch arm is rotatable about the pivot axis in relation to a friction face which is fixed abutting thereagainst, and a second braking apparatus which is coupled with the first braking apparatus, wherein a reciprocal pressing of the friction faces of the friction pairing or of at least one of the friction pairings of the first braking apparatus is effected in dependence on a braking force which is exerted by the second braking apparatus, the second braking apparatus comprises at least one driven damper face which is rotatable about the pivot axis, and which is driven by the rotation of the catch arm about the pivot axis and at least one fixed damper face which encloses at least one gap in which is situated a viscous damping medium which, when the at least one driven damper face is rotated in relation to the at least one fixed damper face, produces a braking force of the second braking apparatus.

13. The pull-out blocking device as claimed in claim 1, wherein the driver or the catch arm comprises at least one sliding path and the other of said driver or said catch arm comprises at least one projection which moves into the at least one sliding path when the pull-out furniture part is pushed in, the sliding path comprises an initial portion, by which the projection is guided in a direction which encloses an angle ($\alpha$) of less than 45° with the pull-out direction of the pull-out furniture part, and a continuing portion which follows the initial portion and by which the projection is guided in a direction which encloses an angle of more than 45° with the pull-out direction of the pull-out furniture part.

14. The pull-out blocking device as claimed in claim 13, wherein the projection is guided at least by part of the initial portion, which follows the start of the initial portion remote from the continuing portion, in a direction which encloses an angle of less than 30° with the pull-out direction of the pull-out furniture part.

* * * * *